US006786819B2

(12) United States Patent
Baerlocher et al.

(10) Patent No.: US 6,786,819 B2
(45) Date of Patent: Sep. 7, 2004

(54) APPARATUS AND METHOD OF OPERATING A GAMING DEVICE HAVING A CENTRAL GAME AND A PLURALITY OF PERIPHERAL GAMES

(75) Inventors: Anthony J. Baerlocher, Reno, NV (US); Andrea C. Hughs-Baird, Reno, NV (US); Chester E. Stites, Jr., Reno, NV (US)

(73) Assignee: IGT, Reno, NV (US)

( * ) Notice: Subject to any disclaimer, the term of this patent is extended or adjusted under 35 U.S.C. 154(b) by 93 days.

(21) Appl. No.: 10/085,520

(22) Filed: Feb. 28, 2002

(65) Prior Publication Data

US 2003/0162583 A1 Aug. 28, 2003

(51) Int. Cl.[7] ..... A63F 9/24
(52) U.S. Cl. ..... 463/20; 463/16
(58) Field of Search ..... 463/16, 20; 273/143 R, 273/138.1, 139, 140, 141 R, 141 A, 142 R

(56) References Cited

U.S. PATENT DOCUMENTS

| | | | |
|---|---|---|---|
| 4,624,459 | A | 11/1986 | Kaufman |
| 4,695,053 | A | 9/1987 | Vazquez, Jr. et al. |
| 4,732,386 | A | 3/1988 | Rayfiel |
| 4,756,531 | A | 7/1988 | DiRe |
| 5,342,047 | A | 8/1994 | Heidel et al. |
| 5,407,200 | A | 4/1995 | Zalabak |
| 5,449,173 | A | 9/1995 | Thomas et al. |
| 5,501,455 | A | 3/1996 | Hirata et al. |
| 5,722,891 | A | 3/1998 | Inoue |
| 5,788,573 | A | 8/1998 | Baerlocher et al. |
| 5,823,874 | A | 10/1998 | Adams |
| 5,848,932 | A | 12/1998 | Adams |
| 5,873,781 | A | 2/1999 | Keane |
| 5,882,261 | A | 3/1999 | Adams |
| 5,911,418 | A | 6/1999 | Adams |
| 5,919,088 | A | 7/1999 | Weiss |
| 5,947,820 | A | 9/1999 | Morro et al. |
| 5,980,384 | A | 11/1999 | Barrie |
| 5,997,401 | A | 12/1999 | Crawford |
| 6,004,207 | A | 12/1999 | Wilson, Jr. et al. |
| 6,015,346 | A | 1/2000 | Bennett |
| 6,033,307 | A | 3/2000 | Vancura |
| 6,059,289 | A | 5/2000 | Vancura |
| 6,062,980 | A | 5/2000 | Luciano |
| 6,089,976 | A | 7/2000 | Schneider et al. |
| 6,089,978 | A | 7/2000 | Adams |
| 6,093,102 | A | 7/2000 | Bennett |
| 6,102,798 | A | 8/2000 | Bennett |

(List continued on next page.)

FOREIGN PATENT DOCUMENTS

| | | | |
|---|---|---|---|
| EP | 000945837 A2 * | 9/1999 | ..... G06F/17/32 |
| GB | 2100905 | 6/1981 | |
| GB | 2106293 | 9/1981 | |

(List continued on next page.)

OTHER PUBLICATIONS

Addams Family Advertisement written by International Game Technology, published in 2000.

(List continued on next page.)

*Primary Examiner*—Teresa Walberg
*Assistant Examiner*—Julie Brocketti
(74) *Attorney, Agent, or Firm*—Bell, Boyd & Lloyd, LLC

(57) ABSTRACT

The present invention includes a gaming device and a method for operating the gaming device. The gaming device of the present invention includes: (i) a central game in which a player picks at least one masked central game outcome, including a transfer; (ii) at least one peripheral game that begins after the player's pick of the transfer, wherein the player picks at least one masked peripheral game outcome, including a return; (iii) whereby the game enables the player to return to the central game and pick at least one more masked central game outcome after the player picks the return in the peripheral game.

51 Claims, 17 Drawing Sheets

U.S. PATENT DOCUMENTS

| | | | | | |
|---|---|---|---|---|---|
| 6,113,098 | A | | 9/2000 | Adams | |
| 6,120,031 | A | | 9/2000 | Adams | |
| 6,126,542 | A | | 10/2000 | Fier | |
| 6,135,884 | A | | 10/2000 | Hedrick et al. | |
| 6,142,873 | A | | 11/2000 | Weiss et al. | |
| 6,146,273 | A | | 11/2000 | Olsen | |
| 6,159,097 | A | | 12/2000 | Gura | |
| 6,159,098 | A | | 12/2000 | Slomiany et al. | |
| 6,162,121 | A | | 12/2000 | Morro et al. | |
| 6,168,520 | B1 | | 1/2001 | Baerlocher et al. | |
| 6,173,955 | B1 | | 1/2001 | Perrie et al. | |
| 6,174,235 | B1 | | 1/2001 | Walker et al. | |
| 6,186,894 | B1 | | 2/2001 | Mayeroff | |
| 6,190,254 | B1 | | 2/2001 | Bennett | |
| 6,190,255 | B1 | | 2/2001 | Thomas et al. | |
| 6,224,483 | B1 | | 5/2001 | Mayeroff | |
| 6,227,971 | B1 | | 5/2001 | Weiss | |
| 6,227,972 | B1 | | 5/2001 | Walker et al. | |
| 6,231,442 | B1 | | 5/2001 | Mayeroff | |
| 6,234,897 | B1 | | 5/2001 | Frohm et al. | |
| 6,261,177 | B1 | | 7/2001 | Bennett | |
| 6,283,855 | B1 | | 9/2001 | Bingham | |
| 6,302,790 | B1 | | 10/2001 | Brossard | |
| 6,309,300 | B1 | | 10/2001 | Glavich | |
| 6,312,334 | B1 | | 11/2001 | Yoseloff | |
| 6,315,664 | B1 | | 11/2001 | Baerlocher et al. | |
| 6,328,649 | B1 | | 12/2001 | Randall et al. | |
| 6,334,814 | B1 | | 1/2002 | Adams | |
| 6,338,678 | B1 | | 1/2002 | Seelig et al. | |
| 6,343,988 | B1 | * | 2/2002 | Walker et al. | 463/21 |
| 6,347,795 | B1 | | 2/2002 | DeLeljer | |
| 6,347,996 | B1 | | 2/2002 | Gilmore et al. | |
| 6,364,766 | B1 | * | 4/2002 | Anderson et al. | 463/16 |
| 6,375,187 | B1 | | 4/2002 | Baerlocher | |
| 6,375,567 | B1 | * | 4/2002 | Acres | 463/25 |
| 6,398,218 | B1 | | 6/2002 | Vancura | |
| 6,398,644 | B1 | | 6/2002 | Perrie et al. | |
| 6,406,369 | B1 | | 6/2002 | Baerlocher et al. | |
| 6,413,160 | B1 | | 7/2002 | Vancura | |
| 6,428,412 | B1 | | 8/2002 | Anderson et al. | |
| 6,439,995 | B1 | | 8/2002 | Hughs-Baird et al. | |
| 6,443,837 | B1 | | 9/2002 | Jaffe et al. | |
| 6,450,884 | B1 | | 9/2002 | Seelig et al. | |
| 6,454,651 | B1 | | 9/2002 | Yoseloft | |
| 6,482,089 | B2 | | 11/2002 | Demar et al. | |
| 6,491,584 | B2 | | 12/2002 | Graham et al. | |
| 6,494,645 | B1 | | 12/2002 | Seitz et al. | |
| 6,506,117 | B2 | | 1/2003 | DeMar et al. | |
| 6,508,707 | B2 | * | 1/2003 | DeMar et al. | 463/16 |

FOREIGN PATENT DOCUMENTS

| | | | | | |
|---|---|---|---|---|---|
| GB | 2090690 | | | 7/1982 | |
| GB | 2096376 | | | 10/1982 | |
| GB | 2137392 | | | 10/1984 | |
| GB | 2144644 | | | 3/1985 | |
| GB | 2144644 | A | * | 3/1985 | A63F/9/22 |
| GB | 2153572 | | | 8/1985 | |
| GB | 2170636 | | | 8/1986 | |
| GB | 2191030 | | | 2/1987 | |
| GB | 2180682 | | | 4/1987 | |
| GB | 2181589 | | | 4/1987 | |
| GB | 2183882 | | | 6/1987 | |
| GB | 2222712 | | | 3/1990 | |
| GB | 2225889 | | | 6/1990 | |
| GB | 2242300 | | | 9/1991 | |

OTHER PUBLICATIONS

American Bandstand (Wheel) Advertisement written by International Game Technology, published in 2002.

Enchanted Unicorn Advertisement written by International Game Technology, published in 2001.

Jazzy Jackpot Advertisement written by Atronic Casino Technology, Ltd., published in 2001.

Money to Burn Advertisement written by WMS, publication date unknown.

Pink Panther Trail Advertisement written by International Game Technology, published in 2000.

* cited by examiner

APPARATUS AND METHOD OF OPERATING A GAMING DEVICE HAVING A CENTRAL GAME AND A PLURALITY OF PERIPHERAL GAMES

CROSS-REFERENCE TO RELATED APPLICATIONS

This application is related to the following co-pending commonly-owned patent applications: "GAMING DEVICE HAVING SELECTIVELY ACCESSIBLE BONUS SCHEME," Ser. No. 09/657,916; "GAMING DEVICE HAVING A WEIGHTED PROBABILITY FOR SELECTING A BONUS GAME," Ser. No. 09/680,346; "GAMING DEVICE WITH A BONUS SCHEME INVOLVING MOVEMENT ALONG PATHS WITH PATH CHANGE CONDITIONS," Ser. No. 09/686,538; "GAMING DEVICE HAVING BONUS GAME TERMINATOR THAT ACTIVATES A MECHANICAL DEVICE," Ser. No. 09/960,788; and "GAMING DEVICE HAVING AN AWARD DISTRIBUTOR AND AN AWARD ACCUMULATOR BONUS GAME," Ser. No. 09/682,369.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device that includes a central game and a plurality of dependent peripheral games, wherein the central and peripheral games are linked via do-until selection loops.

BACKGROUND OF THE INVENTION

Known gaming devices provide an award associated with a masked selector. European Patent Application No. EP 0 945 837 A2 filed on Mar. 18, 1999 and assigned on its face to WMS Gaming, Inc. discloses a slot machine game, wherein the gaming device operates in a normal slot machine or basic mode by randomly selecting a basic game outcome from a plurality of basic game outcomes. If the game selects a start bonus outcome, the gaming device shifts from the normal slot machine or basic mode to a bonus mode.

In the bonus mode, which operates under player control, the player has one or more opportunities to pick masking selections. The masking selections mask awards and end-bonus outcomes. When the player picks a masking selector associated with an award, the game reveals the selection and provides the award to the player. When the player picks a masking selector associated with an end-bonus outcome, the bonus mode no longer enables the player to pick masking selections.

The select-until or do-until selection loop is exciting for the player because the player accrues awards until picking an end-bonus outcome. The do-until selection loop provides the player with the sense that the player controls their own destiny. The game of the European Patent Application No. EP 0 945 837 A2 is somewhat limited in that it provides and displays a single masked selection pool from which the player selects. A need therefore exists for a more enjoyable and entertaining do-until game having a plurality of selection pools.

SUMMARY OF THE INVENTION

The present invention includes a gaming device and a method for operating the gaming device. The gaming device of the present invention includes at least one central game and at least one and preferably a plurality of peripheral games. The central game includes at least one and preferably a plurality of masked central game outcomes. One of the central game outcomes and preferably a plurality of the central game outcomes are transfer outcomes or transfers. One of the peripheral games begins after the player picks a transfer outcome. The peripheral game includes at least one (preferably masked) peripheral game outcome. One of the peripheral game outcomes includes a return outcome or return. The game enables the player to return to the central game and pick at least one more masked central game outcome after the player picks a return in a peripheral game.

The central game preferably enables the player to pick a plurality of masked central game outcomes until the player picks a transfer to one of the peripheral games. In one embodiment of the present invention, each peripheral game enables the player to pick a plurality of masked peripheral game outcomes until the player picks a return.

The preferred embodiment of the present invention provides a plurality of peripheral games and a different transfer for each peripheral game, whereby the player's pick of a particular transfer determines which peripheral game the gaming device invokes. The present invention alternatively provides a plurality of peripheral games and one or more transfers, whereby the game randomly chooses a peripheral game after the player picks a transfer.

Both the central and the peripheral game outcomes include awards, such that the player may win awards while playing both the central and the peripheral games. The present invention includes structuring the awards such that either the central game or the peripheral games have higher average awards. The present invention includes either the central game outcomes, the peripheral game outcomes or both game outcomes including at least one game terminator. When the player picks a game terminator in either the central or one of the peripheral games, the game of the present invention ends.

In a preferred embodiment, the game either randomly associates, assigns or predetermines an outcome, i.e., an award, a transfer or a game terminator to each masking selector before the player picks masked outcomes from the central game. Likewise, the game either randomly associates, assigns or predetermines an outcome, i.e., an award, a return or a game terminator to each masking selector before the player picks masked outcomes from one of the peripheral games. The game alternatively randomly generates one of the central game outcomes upon the player's pick of a central game selector. The game further alternatively randomly generates one of the peripheral game outcomes upon the player's pick of a peripheral game selector.

In an alternative embodiment, the processor of the gaming device picks peripheral game outcomes as opposed to the player. In this alternative embodiment, the present invention includes: (i) a central game in which a player picks at least one masked central game outcome, including a transfer; (ii) at least one peripheral game that begins after the player's pick of the transfer, wherein the game's processor picks at least one masked peripheral game outcome, including a return; and (iii) whereby the game enables the player to return to the central game and pick at least one more masked central game outcome after the processor picks the return.

In the alternative embodiment, as above, the central game enables the player to pick a plurality of masked central game outcomes until the player picks the transfer. In the peripheral game, the processor picks a plurality of masked peripheral game outcomes until picking a return. The alternative embodiment also preferably includes a plurality of peripheral games and a different transfer for each peripheral game, whereby the player's pick of a particular transfer determines which peripheral game the game invokes. The alternative embodiment alternatively includes the game randomly choosing a peripheral game after the player picks a peripheral game outcome.

One preferred method for operating the above described gaming device includes the steps of: (i) enabling a player to pick at least one masked central game outcome in a central game; (ii) after the player picks a transfer, enabling at least one pick of a peripheral game outcome in a peripheral game; and (iii) after picking a return, enabling the player to again pick at least one masked central game outcome from said central game. The method includes repeating the steps (i) through (iii) a plurality of times and preferably includes repeating the steps until a game terminator is picked.

The method preferably enables the player to pick from the central game until the player picks a transfer. The method also preferably enables the player to pick from the peripheral game until the player picks a return. The method alternatively enables the game's processor to pick from the peripheral game until the processor picks a return.

It is therefore an advantage of the present invention that the gaming apparatus and associated method include a central game and a plurality of dependent peripheral games.

Another advantage of the present invention is that the central and peripheral games are linked via do-until selection loops.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
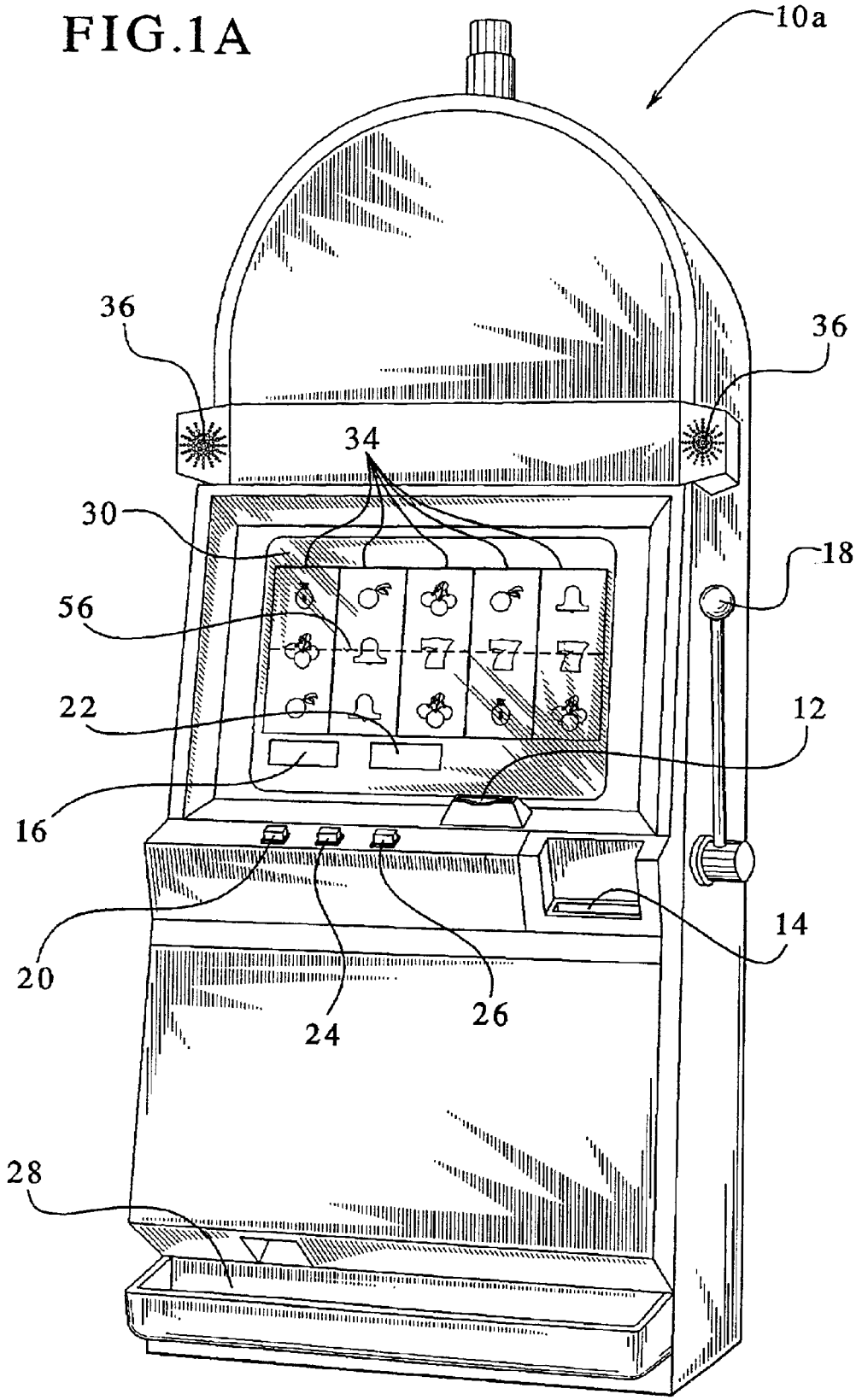
FIG. 1A is a front-side perspective view of one embodiment of the gaming device of the present invention.
Figure 1B:
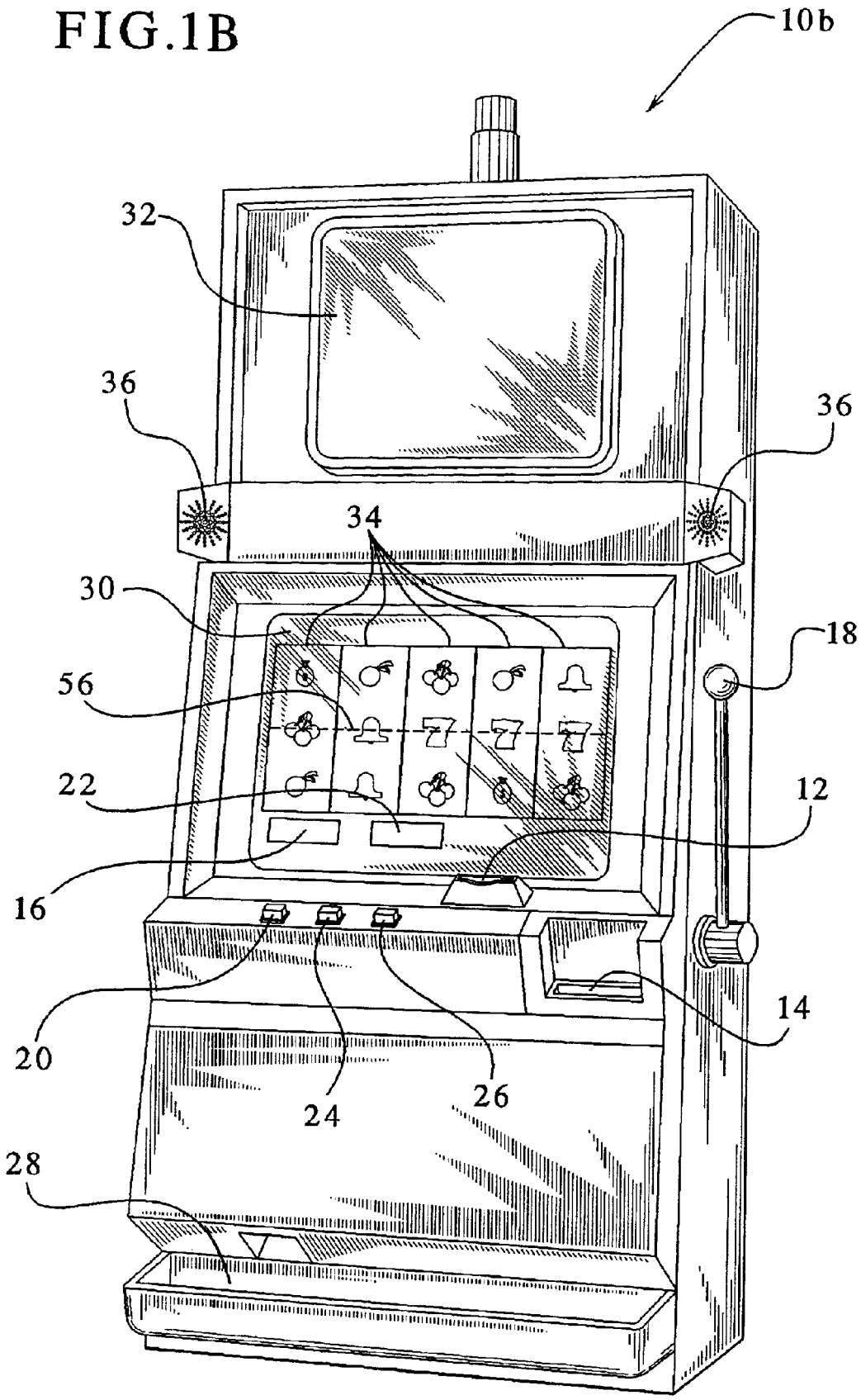
FIG. 1B is a front-side perspective view of another embodiment of the gaming device of the present invention.

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sifting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
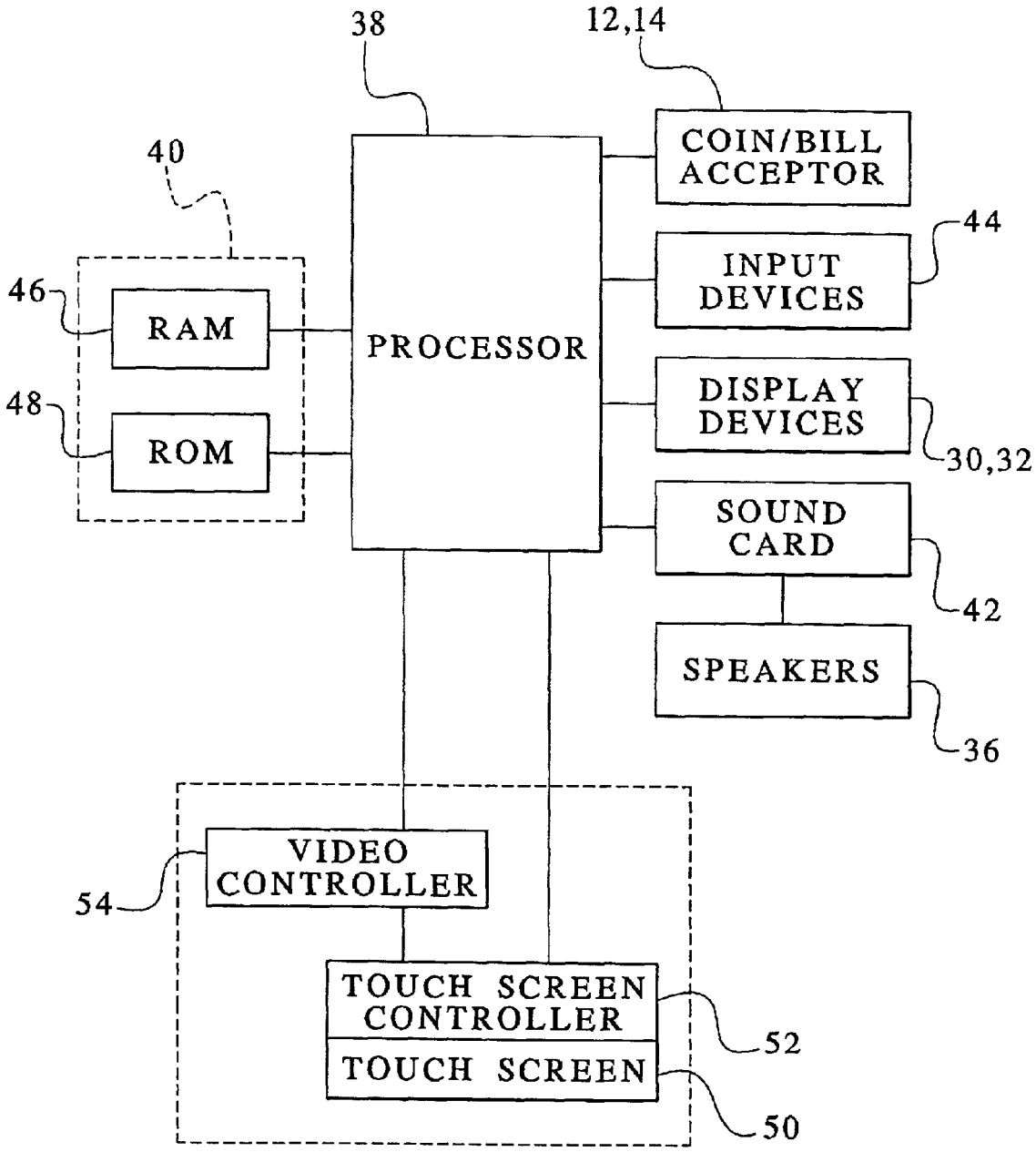
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on three adjacent reels 34 along a payline 56. It should be appreciated that the present invention includes one or more paylines, such as payline 56, wherein the paylines can be horizontal, diagonal or any combination thereof.

General Configurations

Figure 3A:
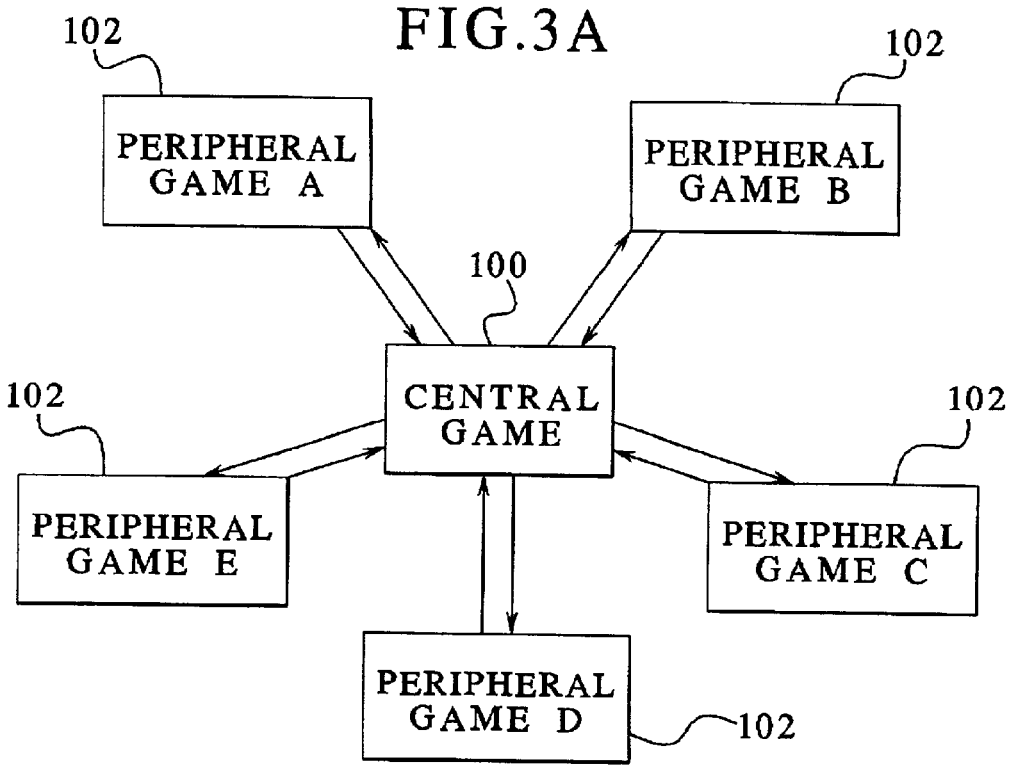
FIG. 3A is a schematic diagram of one general configuration of the present invention, wherein game play is able to transfer from the central game to each of the peripheral games and from each of the peripheral games back to the central game.
Figure 3B:
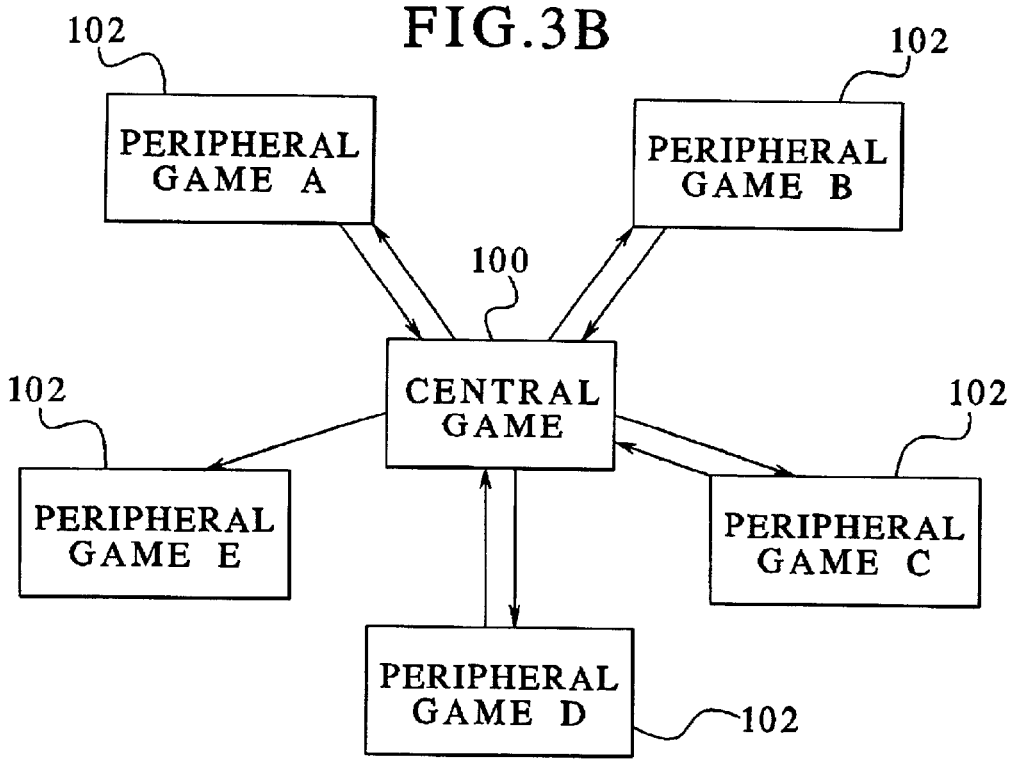
FIG. 3B is a schematic diagram of another general configuration of the present invention, wherein game play is able to transfer from the central game to each of the peripheral games but not from all of the peripheral games back to the central game.
Figure 3C:
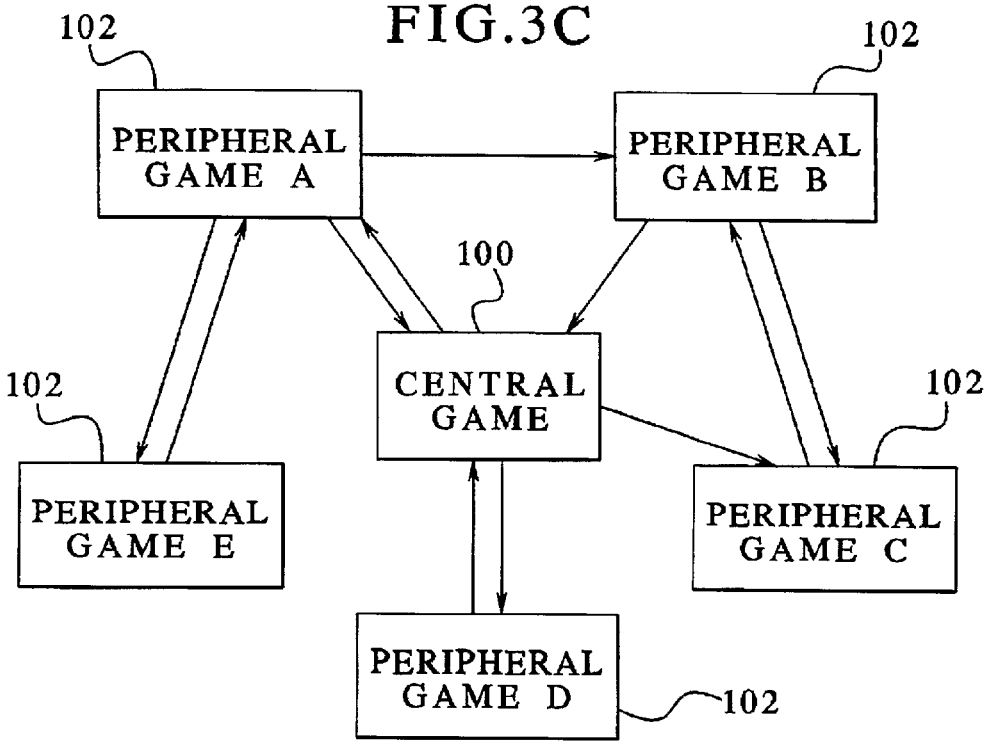
FIG. 3C is a schematic diagram of a further general configuration of the present invention, wherein game play is able to transfer from at least one peripheral game to at least one other peripheral game.

Referring now to FIGS. 3A through 3C, three general configurations of the present invention include a central game 100 and a plurality of peripheral games 102, designated here and throughout the application as peripheral GAME A through GAME E. The present invention includes providing any number of peripheral games 102. The configuration of FIG. 3A illustrates a game in which game play is able to return from the central game 100 to each of the peripheral games, and wherein game play is able to transfer from each of the peripheral games 102 back to the central game 100.

The configuration of FIG. 3B illustrates a game in which game play is able to transfer from the central game 100 to each of the peripheral games, but wherein game play is not able to return from each of the peripheral games 102 back to the central game 100. FIG. 3B illustrates that game play is not able to return from the peripheral GAME E back to the central game 100. It should be appreciated that the present invention includes not enabling game play to return back from a plurality of the peripheral games 100, including all of the peripheral games. In one preferred embodiment, game play is not able to return back in one game as illustrated in FIG. 3B.

The configuration of FIG. 3C illustrates a game in which game play is able to transfer from the central game 100 to one or more of the peripheral games 102, wherein game play is able to return from at least one peripheral game 102 to the central game 100, and wherein game play is able to transfer from at least one peripheral game 102 to at least one other peripheral game 102. For example, FIG. 3C illustrates that game play is able to transfer from peripheral GAME E to peripheral GAME A and conversely from peripheral GAME A to peripheral GAME E. Peripheral GAME A also returns to the central game 100, while peripheral GAME E does not. Peripheral GAME D does not transfer to any other peripheral game, nor does any peripheral game transfer to peripheral GAME D. The present invention only requires that either the central game 100 or one peripheral game 102 transfer to any given peripheral game 102. The present invention further only requires that the central game 100 transfer to one peripheral game 102 and does not require a return from any peripheral game 102.

Central Game and Peripheral Game Structure

Figure 4A:
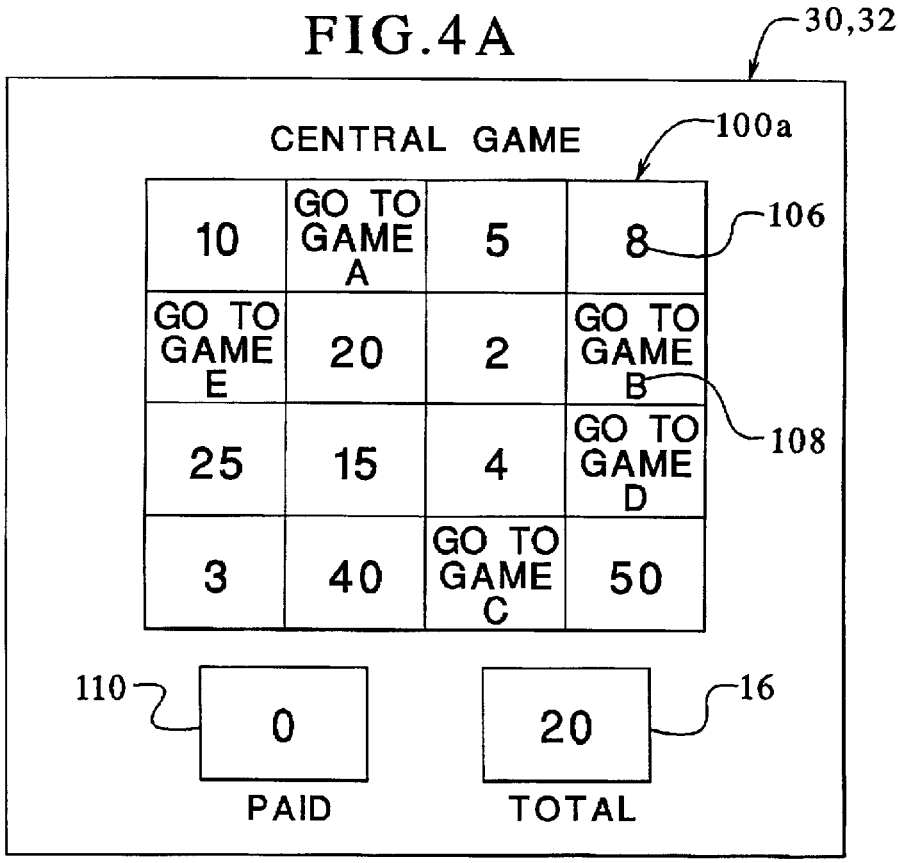
FIG. 4A is a front elevation view of one of the display devices FIGS. 1A and 1B illustrating one embodiment of a central game having the selections unmasked to show each possible central game outcome.

Referring now to FIG. 4A one embodiment of a central game 100*a* is illustrated fully revealed (i.e., with the selections unmasked) on one of the display devices 30 or 32 to show each of its central game outcomes. The central game 100*a* includes one or more award outcomes or awards 106 and one or more transfers 108. The embodiment of FIG. 4A also includes a paid display 110 and a simulated form of the credit display 16. In certain instances, the display devices 30 or 32 of the present invention include other indicators and selections (not illustrated) associated with the base games of slot, poker, blackjack, keno, etc. or with a stand alone embodiment.

The game preferably displays the central game 100*a*, including the awards 106 and the transfers outcomes or transfers 108 as well as masking selections (illustrated below), the paid display 110, the simulated credit display 16, the peripheral games 102 (FIGS. 3A, 3B, 5A through 5D, 6A through 6C) and other theme building indicia (not illustrated) on a video monitor. The game preferably employs a touch screen 50 and a touch screen controller 52 such that each masking selection, which masks one of the outcomes of the central game 100*a* or the peripheral games, is a separate player selectable area on the video monitor adapted to send a discrete input to the processor 38 or computer, and which input is separate from the inputs sent by other selections.

The game alternatively displays one or more of the central games 100*a*, including the awards 106 and the transfers 108, the paid display 110, the simulated credit display 16, the peripheral games 102 (FIGS. 3A and 3B) and other theme building indicia (not illustrated) on one or more lighted mechanical displays. In the alternative non-simulated game, the game employs separate electromechanical input devices 44 (FIG. 2), similar to the bet one button 24 or the cash out button 26 as selections (illustrated below) to enter inputs into the processor 38 or computer.

The paid display 110 is preferably a simulated indicator on the display device 30 or 32, as illustrated, but is alternatively an electromechanical device mounted to the cabinet of the gaming device 10. The paid display 110 indicates the value of a recent award 106 paid to the player and is distinguishable from the credit display 16, which shows the recent award plus the player's previous total award. In the example beginning with FIG. 4A, the player begins a game of the present invention with twenty awards (from previous play), as indicated by the credit display 16. The game has not yet provided the player any awards 106, as indicated by the paid display 110.

The awards 106 include game credits, credit multipliers or represent other items of value such as a number of picks from a prize pool. The awards 106 include having any value desired by the implementor. The central game 100*a* includes awards ranging from 2 to 50 and is enabled to otherwise include any range having any average value. The game includes the awards 106 of the central game 100*a* being higher or lower, on average, than the awards 106 of the peripheral games, described below.

The central game 100*a* includes a different transfer 108 for each peripheral game 102, i.e., each peripheral game 102 illustrated in FIGS. 3A and 3B. In an alternative embodiment, in certain instances, gaming device 10 does not include a different transfer 108 for each peripheral game 102, and/or gaming device 10 includes two or more transfers 108 for one or more peripheral game 102. The selection of a particular transfer 108, e.g., GOTO GAME A, initiates the play of a particular peripheral game and preferably designates the peripheral game that the processor 38 or computer enables. The game includes an alternative method of selecting and initiating a peripheral game, which is described below.

In the central game 100*a*, the processor 38 or computer randomly places the awards 106 and the transfers 108 in the 4 by 4 array before enabling the player to pick one of the masked outcomes. The game includes an alternative method of generating outcomes, which is described below. It should be appreciated that the present invention includes the central game 100*a* having any number of outcomes and any graphical distribution (rectangular or circular arrays, comprising a path, haphazardly displayed or otherwise) of the outcomes and their associated masking indicia, which the game implementor desires.

Figure 4B:
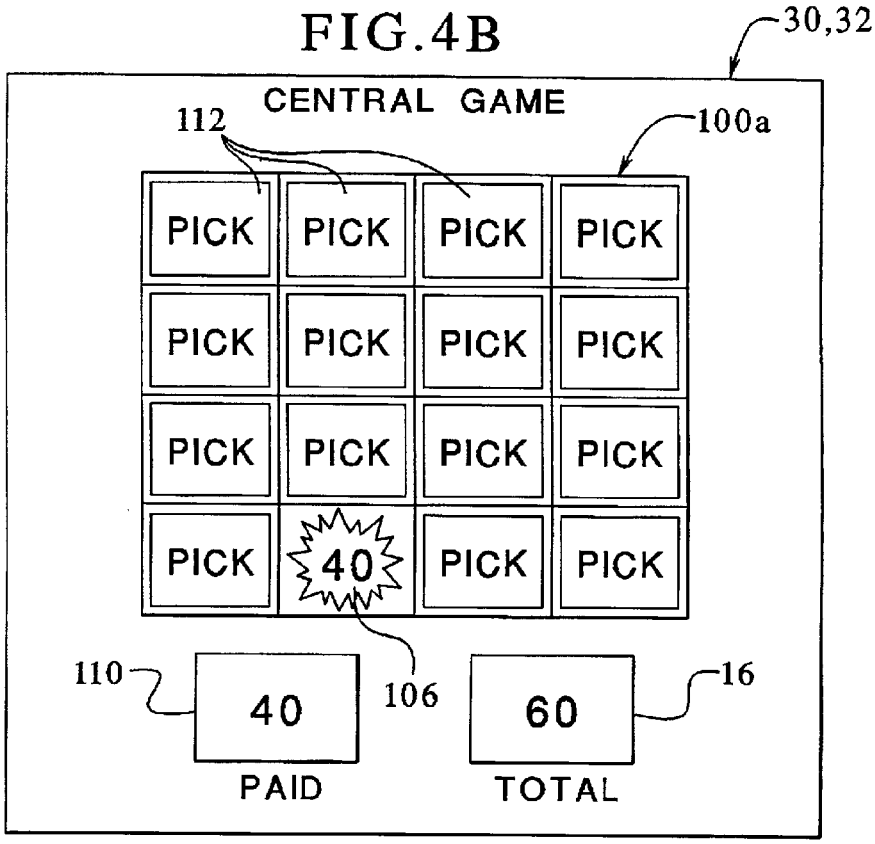
FIGS. 4B through 4G are front elevation views of one of the display devices of FIGS. 1A and 1B illustrating a central game at different stages of one embodiment of the game of the present invention.

Referring now to FIG. 4B, the central game 100*a*, having the award 106 and transfer 108 arrangement of FIG. 4A, is illustrated fully masked on one of the display devices 30 or 32, except for the player's pick of the forty award 106. The paid display 110 illustrates that the game provides the forty award to the player, and the credit display 16 updates the player's total awards. Each of the outcomes is initially masked by a masking selection 112. When the player touches or picks a selection 112 (in a touch screen 50 embodiment), the game removes the mask and reveals the award 106 or transfer 108 hidden beneath.

Figure 4C:
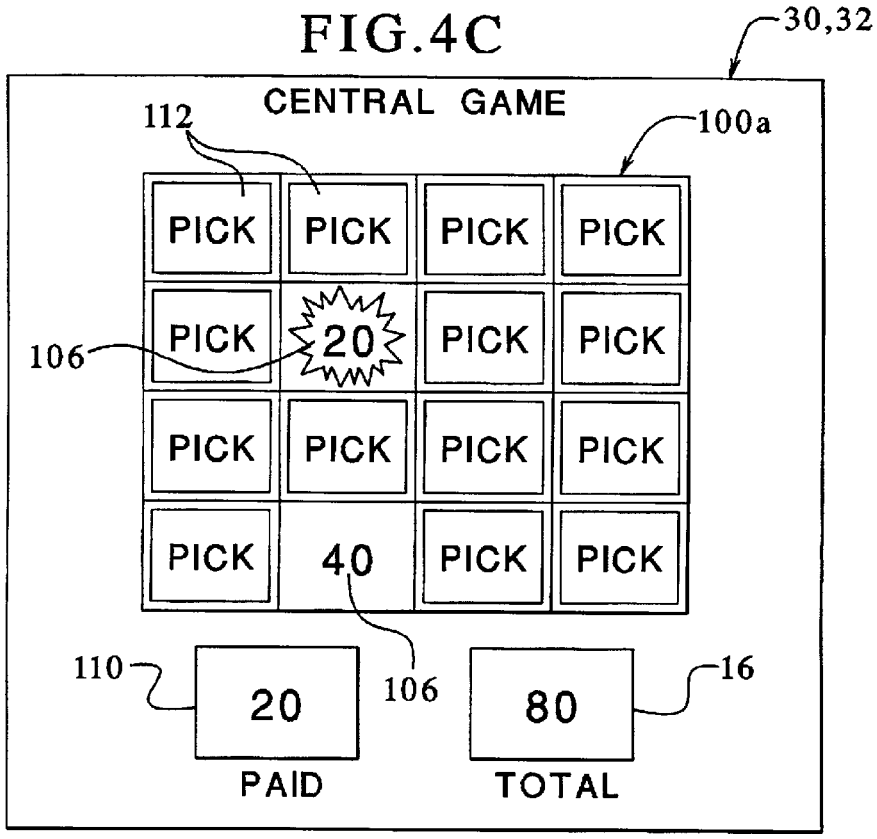

Referring now to FIG. 4C, the player now picks the twenty award 106 from the central game 100*a*, having the outcome arrangement of FIG. 4A. The paid display 110 illustrates that the game provides the twenty award to the player, and the credit display 16 updates the player's total awards. The game preferably still reveals the previously picked forty award 106, such that the player is not enabled to reselect a previously picked outcome. The game alternatively unreveals or remasks a previously picked outcome and redistributes the random layout of the outcomes, whereby the game provides the player with a new fully masked screen and a new central game 100*a* after each of the player's picks until the player invokes a peripheral game.

Figure 4D:
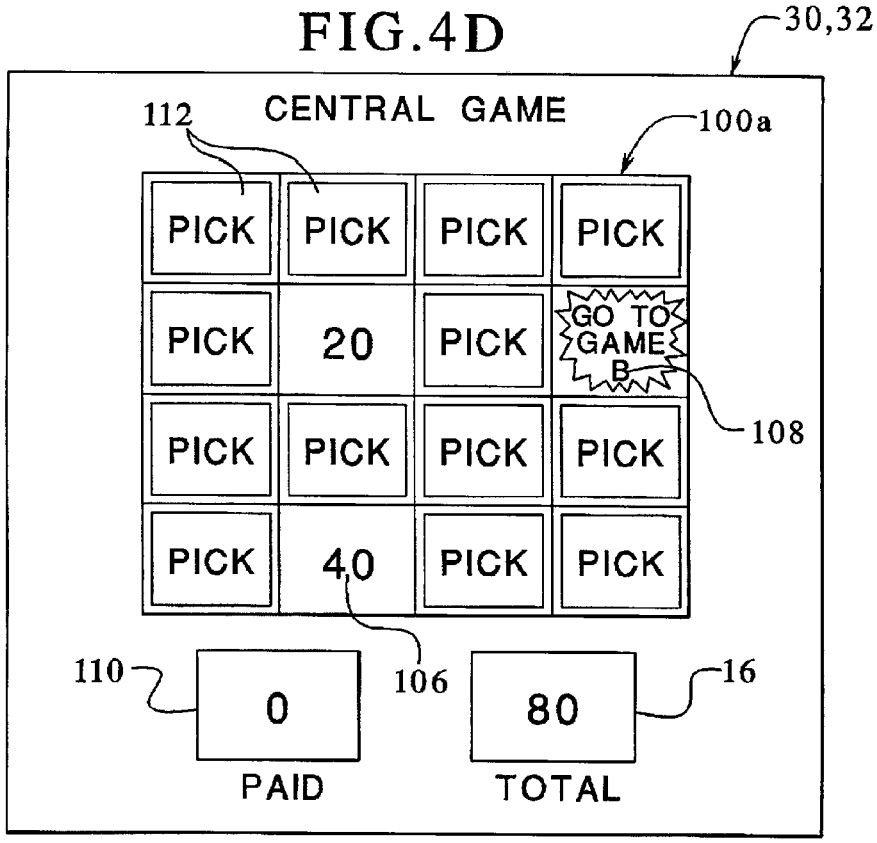

FIGS. 4B and 4C illustrate that the central game 100*a* enables the player to sequentially pick selections 112, whereby the game reveals the awards 106 beneath and provides the awards to the player. In FIG. 4D, the player now picks the GOTO GAME B outcome 108 from the central game 100*a*, having the outcome arrangement of FIG. 4A. The player's pick of the transfer 108 does not provide an award to the player in the central game 100*a*, as indicated by the paid display 110. Other central games 100 alternatively include providing an accompanying award 106 upon the pick of a transfer 108. The player's award total, as indicated by the credit display 16, remains at eighty, as illustrated by FIGS. 4C and 4D. As before, the game preferably continues to reveal the previously selected forty and twenty awards 106.

Figure 5A:
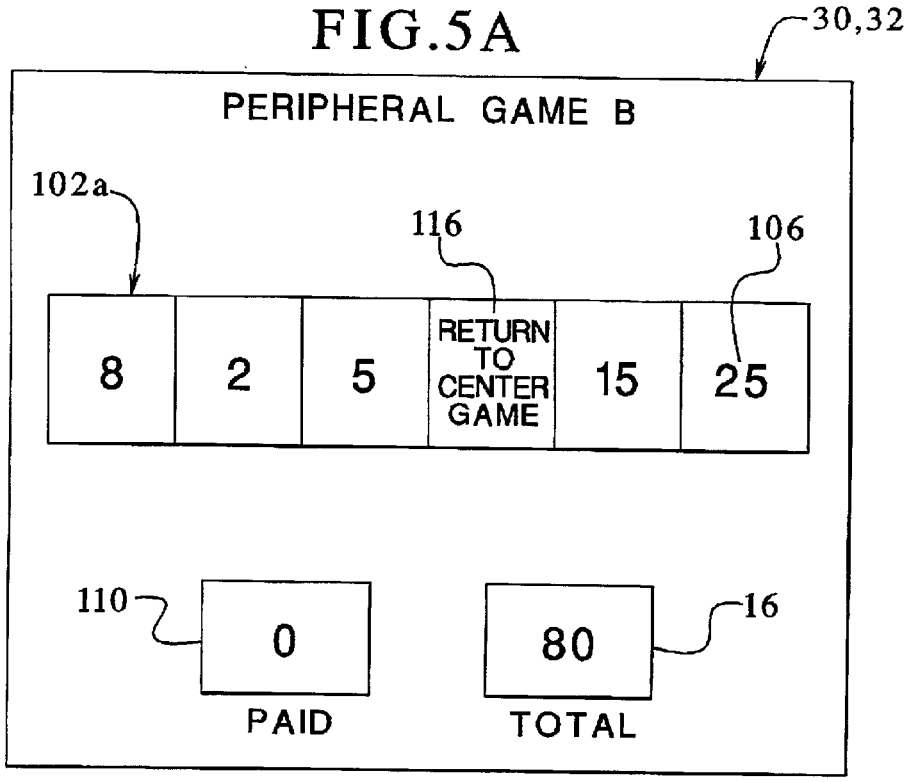
FIG. 5A is a front elevation view of one of the display devices of FIGS. 1A and 1B illustrating one embodiment of a peripheral game fully revealed to show each of its peripheral game outcomes.

Referring now to FIG. 5A, upon the player's pick of the GOTO GAME B outcome 108 in the central game 100*a*, the game preferably discontinues the display of the central game 100*a* on the display device 30 or 32 and displays the peripheral game 102*a*, which is the peripheral GAME B. The game alternatively displays and preferably clearly differentiates both the central game 100*a* and the peripheral game 102*a* on a single screen of the display device 30 or 32. In either case, the game preferably retains the display of certain indicators, such as the paid display 110 and the credit display 16. The credit display 16 continues to display eighty credits, as in FIGS. 4C and 4D.

FIG. 5A is illustrated fully revealed to show each of its peripheral game outcomes and the arrangement thereof. The peripheral game 102*a* includes one or more award outcomes or awards 106 as well as one or more return outcomes or returns 116. The present invention includes the peripheral game awards 106 having any value desired by the implementor. The peripheral game 102*a* includes awards ranging from 2 to 25 and is enabled to otherwise include any range having any average value. The game includes the awards 106 of the peripheral game 102*a* being higher or lower, on average, than the awards 106 of the central game 100*a* or the other peripheral games, described below.

In the peripheral game 102*a* of FIG. 5A, the processor 38 or computer randomly places the awards 106 and the return outcomes 116 in the 6 by 1 array before enabling the player to pick a masked outcome. The game includes an alternative method for generating an outcome, which is described below. It should be appreciated that the present invention includes the peripheral game 102*a* having any number of outcomes and any graphical distribution (rectangular or circular arrays, comprising a path, haphazardly displayed or otherwise) of the outcomes and their associated masking indicia that the game implementor desires.

Figure 5B:
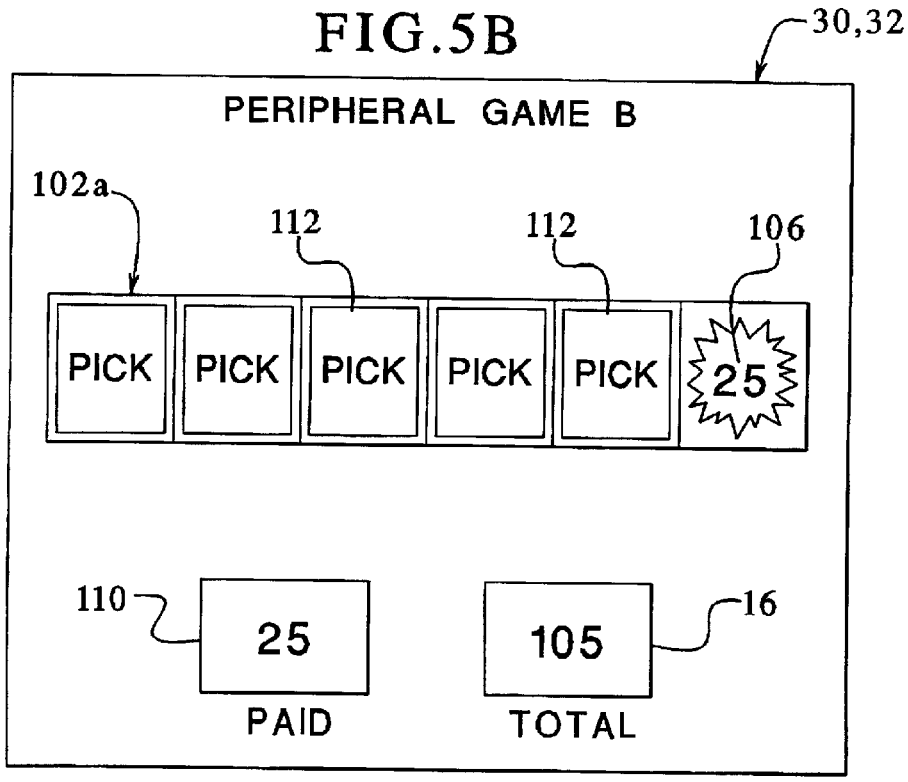
FIGS. 5B through 5D are front elevation views of one of the display devices of FIGS. 1A and 1B illustrating a peripheral game at different stages of one embodiment of the game of the present invention.

Referring now to FIG. 5B, the peripheral game 102*a*, having the award 106 and return outcome 116 arrangement of FIG. 5A, is illustrated fully masked on one of the display devices 30 or 32, except for the player's pick of the twenty-five award 106. The paid display 110 illustrates that the game provides the twenty-five award to the player, and the credit display 16 updates the player's total awards. Each of the outcomes is initially masked by the masking selector 112. When the player touches or picks a selector 112 (in a touch screen 50 embodiment), the game removes the mask and reveals the award 106 or return 116 hidden beneath. In an alternative embodiment, the game, i.e., the processor 38 or computer, randomly picks an award for the player, such as the twenty-five award 106.

Figure 5C:
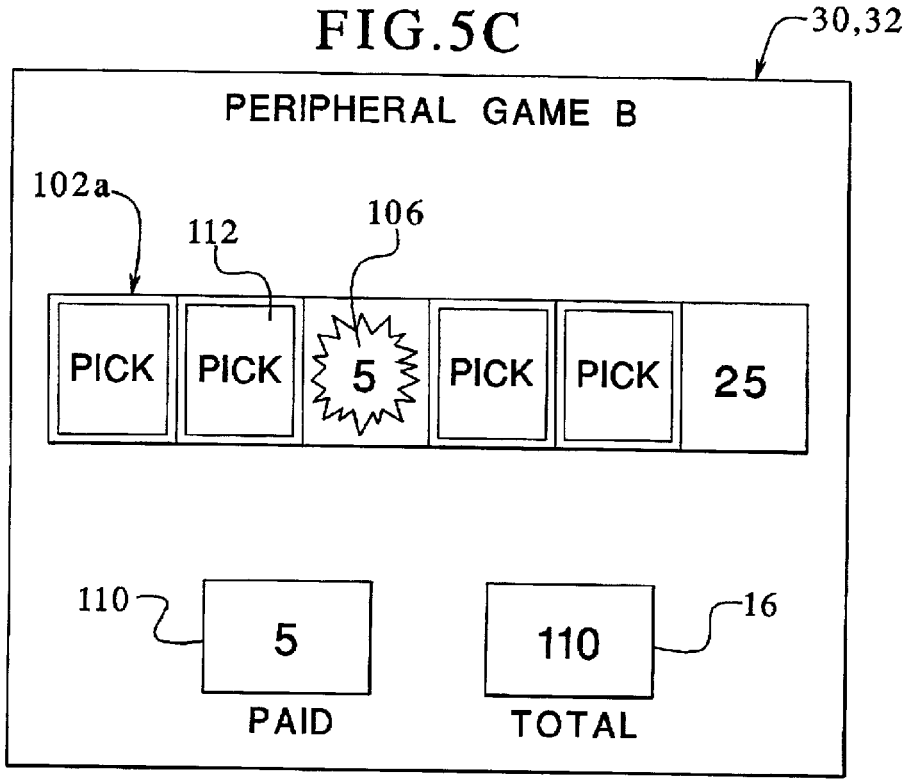

Referring now to FIG. 5C, the player (or alternatively the processor or computer) now picks the five award 106 from the peripheral game 102*a*, having the outcome arrangement of FIG. 5A. The paid display 110 illustrates that the game provides the five award to the player, and the credit display 16 updates the player's total awards. The game preferably still reveals the previously picked twenty-five award 106, such that the player (or the processor or computer) is not enabled to reselect a previously picked outcome. The game alternatively unreveals or remasks a previously picked outcome and redistributes the random layout of the outcomes, whereby the game provides the player (or the processor or computer) with a new fully masked screen and a new peripheral game 102*a* after each of the player's picks until the player returns to the central game.

Figure 5D:
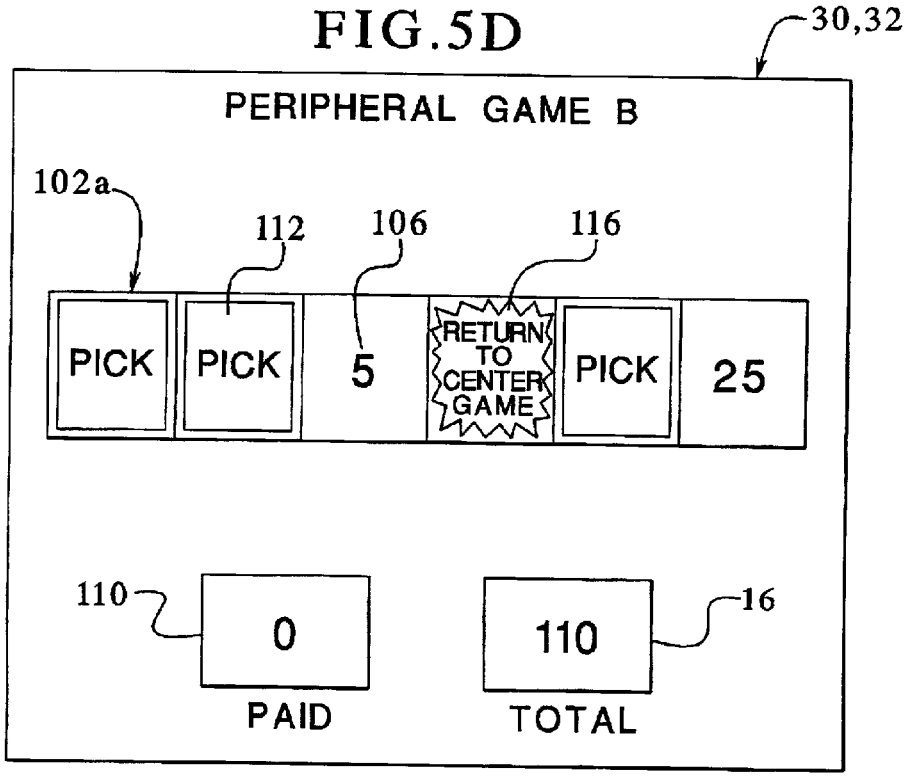

FIGS. 5B and 5C illustrate that the peripheral game 102*a* enables the player (or the processor or computer) to sequentially pick selections 112, whereby the game reveals the awards 106 beneath and provides the awards to the player. In FIG. 5D, the player (or the processor or computer) now picks the RETURN TO CENTRAL GAME outcome 116 from the peripheral game 102*a*, having the outcome arrangement of FIG. 5A. The player's (or the game's) pick of the return outcome 116 does not provide an award to the player in the peripheral game 102*a*, as indicated by the paid display 110. Other peripheral games 102 alternatively include providing an accompanying award 106 upon the pick of a return outcome 108. The player's award total, as indicated by the credit display 16, remains at 110, as illustrated by FIGS. 5C and 5D. When the game no longer enables the player (or the game) to pick selections 112 from the peripheral game 102*a*, the game preferably reveals all of the peripheral game's outcomes and the arrangement thereof. That is, the game displays the fully revealed screen of FIG. 5A.

Figure 4E:
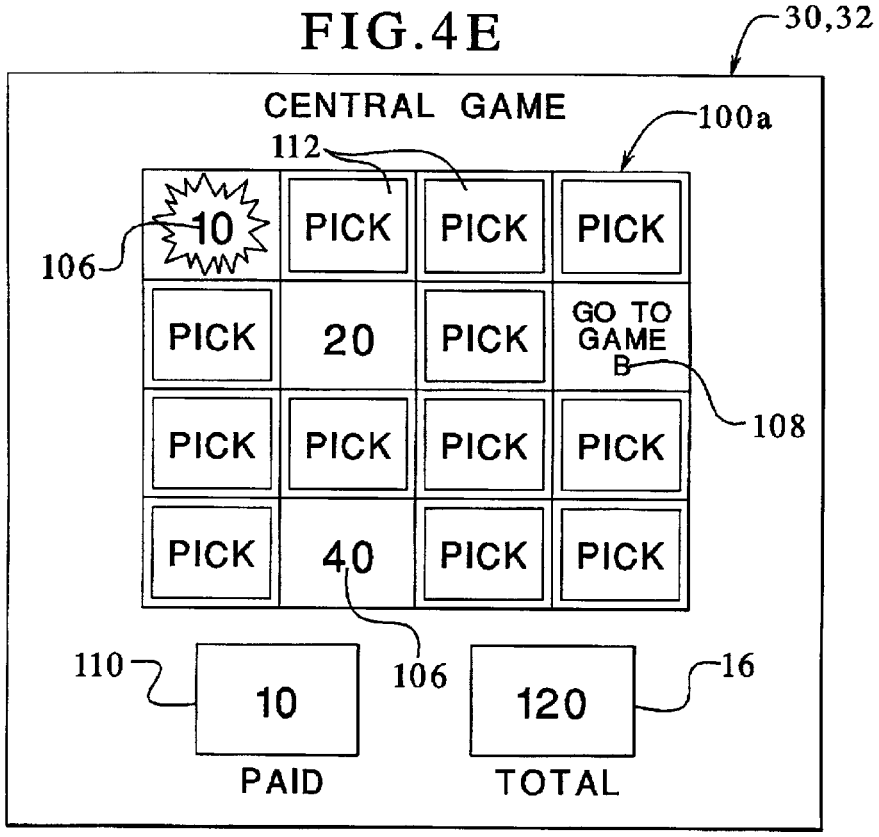

Referring now to FIG. 4E, upon the player's (or the game's) pick of the RETURN TO CENTRAL GAME outcome 116 in the peripheral game 102*a*, and after fully revealing the outcomes of the peripheral game, the game preferably discontinues the display of the peripheral game 102*a* on the display device 30 or 32 and redisplays the central game 100*a*. The game alternatively displays and preferably clearly differentiates both the central game 100*a* and the peripheral game 102*a* on a single screen of the display device 30 or 32. In either case, the game preferably retains the display of the paid display 110 and the credit display 16 and returns to the stage or screen of the central game 100*a* immediately prior to invoking the peripheral game 102*a*.

In FIG. 4E, the player now picks the ten award 106 from the central game 100*a*, having the outcome arrangement of FIG. 4A. The paid display 110 illustrates that the game provides the ten award to the player, and the credit display 16 updates the player's total awards. As before, the game enables the player to sequentially pick selections 112, whereby the game reveals the awards 106 beneath and provides the awards to the player. The game preferably still reveals the previously picked forty and twenty awards 106 and the GOTO GAME B outcome 108, such that the player is not enabled to reselect a previously picked outcome. In another embodiment, gaming device 10 remasks the GOTO GAME B outcome 108 and again enables the player to re-pick the GOTO GAME B outcome.

Figure 4F:
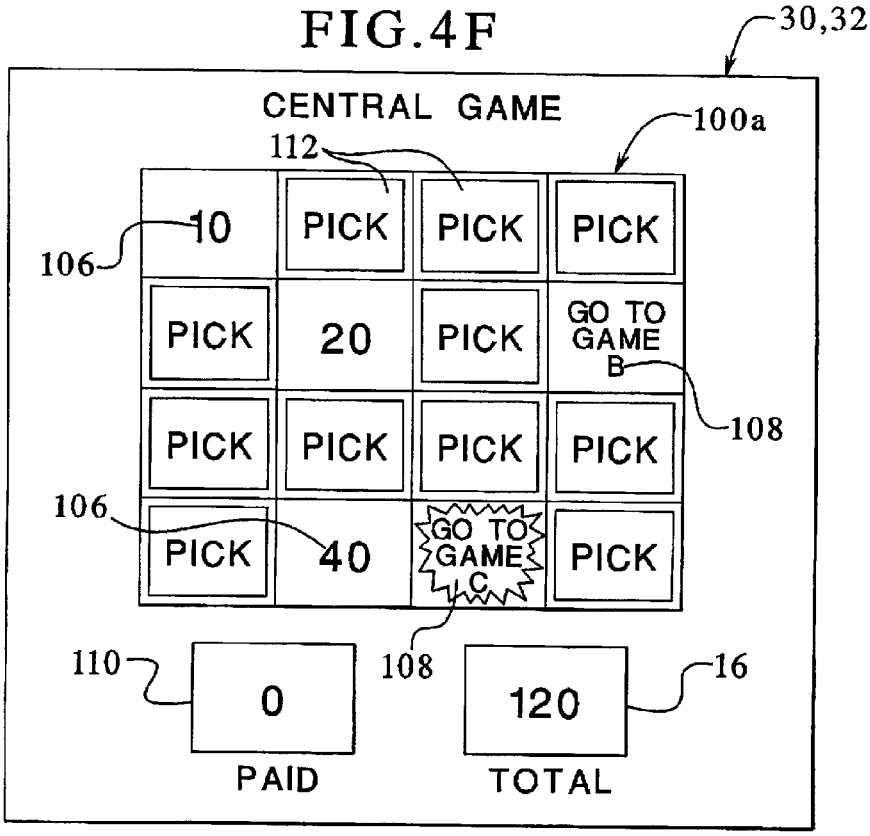

In FIG. 4F, the player now picks the GOTO GAME C outcome 108 from the central game 100*a*, having the outcome arrangement of FIG. 4A. The player's pick of the transfer 108 again does not provide an award to the player in the central game 100*a*, as indicated by the paid display 110. As before, the game preferably continues to reveal all previously selected awards 106 and transfers 108.

Figure 6A:
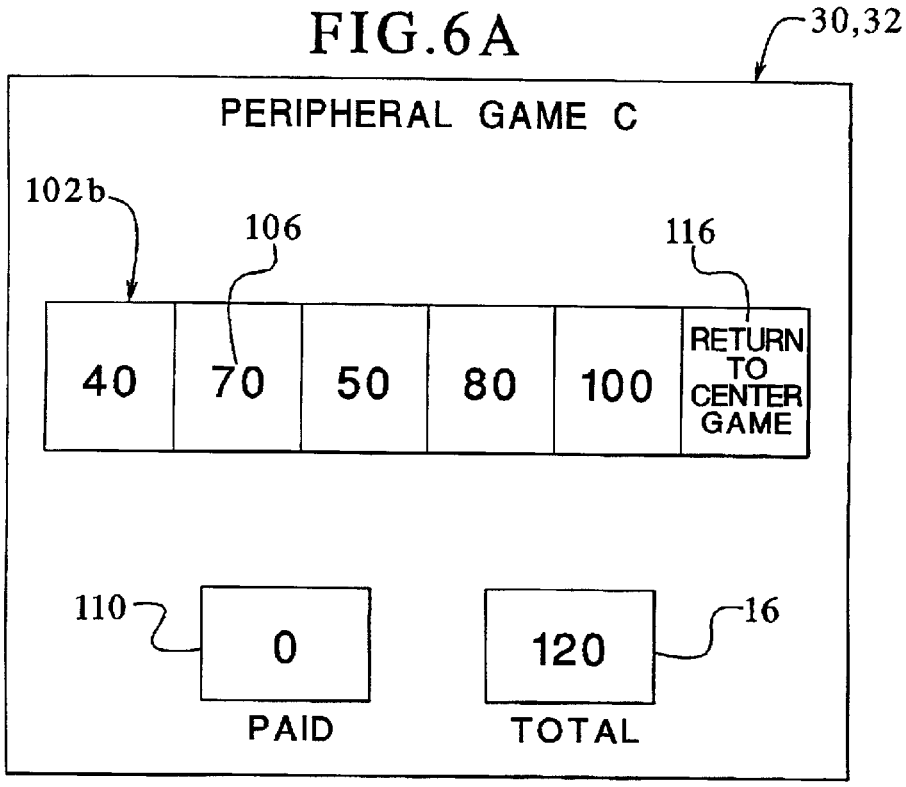
FIG. 6A is a front elevation view of one of the display devices of FIGS. 1A and 1B illustrating another embodiment of a peripheral game having the selections unmasked to show each of its peripheral game outcomes.

Referring now to FIG. 6A, upon the player's pick of the GOTO GAME C outcome 108 in the central game 100*a*, the game preferably discontinues the display of the central game 100*a* on the display device 30 or 32 and displays the peripheral game 102*b*, which is the GAME C. The game preferably retains the display the paid display 110 and the credit display 16. The credit display 16 continues to display 120 credits, as in FIGS. 4E and 4F.

FIG. 6A is illustrated fully revealed to show each of its peripheral game outcomes and the arrangement thereof. The peripheral game 102*b* includes one or more awards 106 as well as one or more return outcomes 116. The peripheral game 102*a* includes awards ranging from 40 to 100, and which have a higher average value than the awards of the central game 100*a* or the peripheral game 102*a*. The game includes the awards 106 of the peripheral game 102*b* being higher or lower, on average, than the awards 106 of the central game 100*a* or the other peripheral games.

In the peripheral game 102*b* of FIG. 6A, the processor 38 or computer randomly places the awards 106 and the return outcomes 116 in the 6 by 1 array before enabling the player to pick a masked outcome. It should be appreciated that the present invention includes the peripheral game 102*b* having any number of outcomes and any graphical distribution (rectangular or circular arrays, comprising a path, haphazardly displayed or otherwise) of the outcomes and their associated masking indicia that the game implementor desires.

Figure 6B:
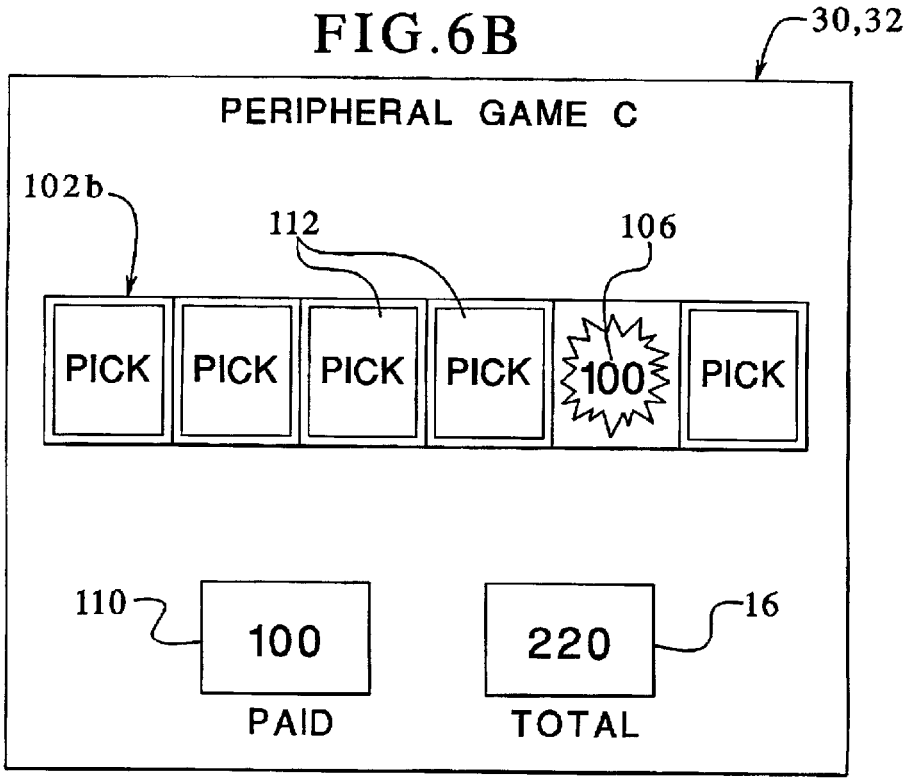
FIGS. 6B and 6C are front elevation views of one of the display devices of FIGS. 1A and 1B illustrating another embodiment of a peripheral game at different stages of the game of the present invention.

Referring now to FIG. 6B, the peripheral game 102*b*, having the award 106 and return outcome 116 arrangement of FIG. 6A, is illustrated fully masked on one of the display devices 30 or 32, except for the player's pick of the one hundred award 106. The paid display 110 illustrates that the game provides the one hundred award to the player, and the credit display 16 updates the player's total awards. Each of the outcomes is initially masked by the masking selector 112. When the player touches or picks a selector 112 (in a touch screen 50 embodiment), the game removes the mask and reveals the award 106 or return outcome 116 hidden beneath. FIG. 6B illustrates that the peripheral game 102*b* enables the player to sequentially pick selections 112, whereby the game reveals the awards 106 beneath and provides the awards to the player. Alternatively, the processor 38 or computer randomly picks an award for the player, such as the one hundred award 106.

Figure 6C:
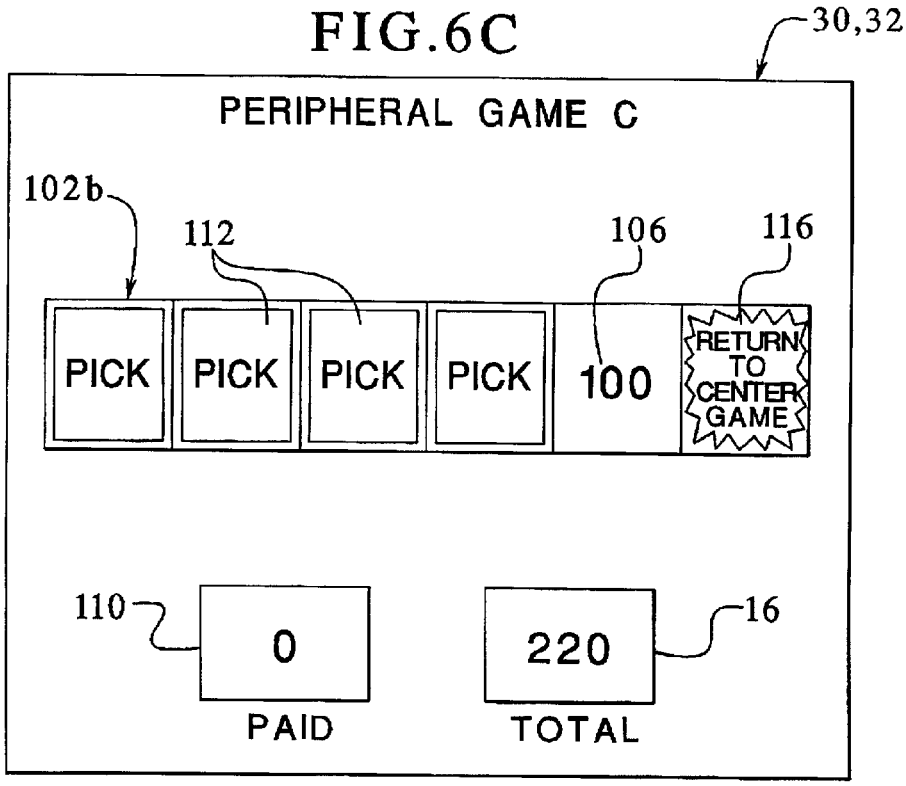

In FIG. 6C, the player (or game) now picks the RETURN TO CENTRAL GAME outcome 116 from the peripheral game 102*b*, having the outcome arrangement of FIG. 6A. The player's pick of the return outcome 116 does not provide an award to the player in the peripheral game 102*b*, as indicated by the paid display 110, and the player's award total, remains at 220, as illustrated by FIGS. 6B and 6C. After the game no longer enables the player (or the game) to pick selections 112 from the peripheral game 102*b*, the game preferably reveals all of the peripheral game's outcomes and the arrangement thereof. That is, the game displays the fully revealed screen of FIG. 6A.

Figure 4G:
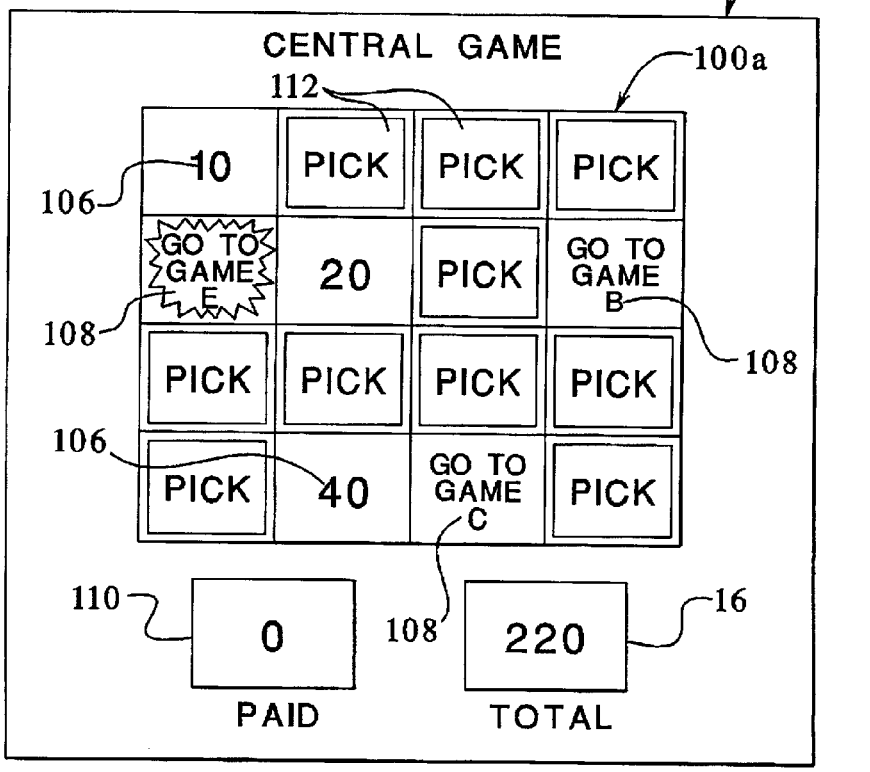

Referring now to FIG. 4G, upon the player's (or the game's) pick of the RETURN TO CENTRAL GAME outcome 116 in the peripheral game 102*b*, and after fully revealing outcomes of the peripheral game, the game preferably discontinues the display of the peripheral game 102*b* on the display device 30 or 32, redisplays the central game 100*a* retaining the display of the paid display 110 and the credit display 16 and returns to the stage or screen of the central game 100*a* immediately prior to invoking the peripheral game 102*b*.

In FIG. 4G, as before, the central game 100*a* enables the player to sequentially pick selections 112, whereby the game reveals the awards 106 and outcomes beneath and provides the awards to the player. The player now picks the GOTO GAME E outcome 108 from the central game 100*a*, having the outcome arrangement of FIG. 4A. The player's pick of the transfer 108 again does not provide an award to the player in the central game 100*a*, as indicated by the paid display 110. As before, the game preferably continues to reveal all previously selected awards 106 and transfers 108.

Figure 7A:
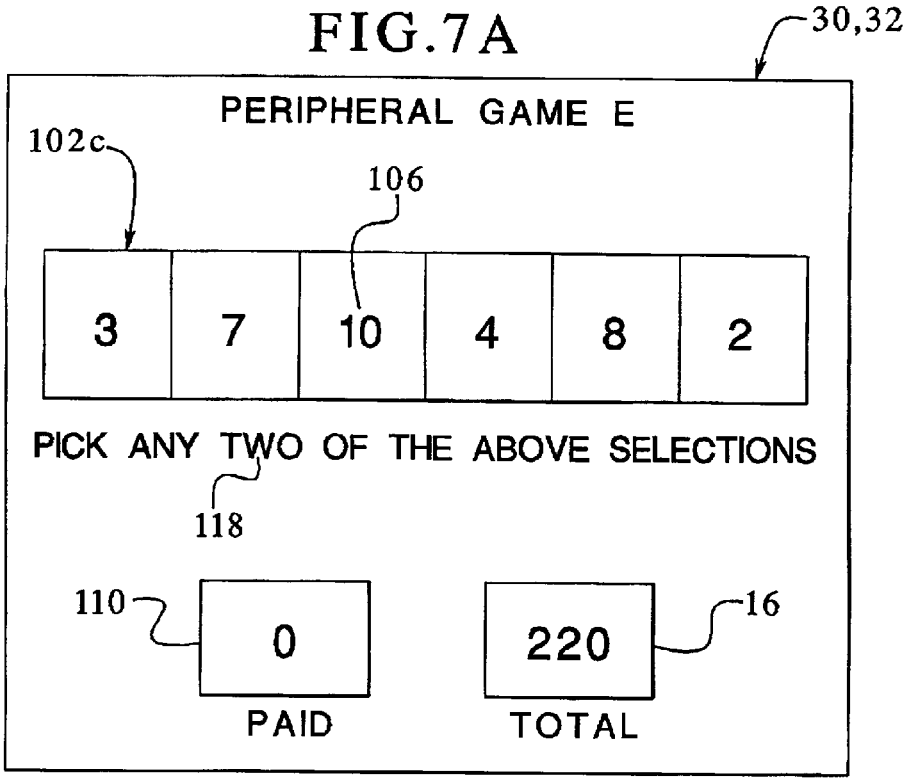
FIGS. 7A through 7C are front elevation views of one of the display devices of FIGS. 1A and 1B illustrating three possible peripheral games that will terminate or have the potential to terminate the game of the present invention.
Figure 7B:
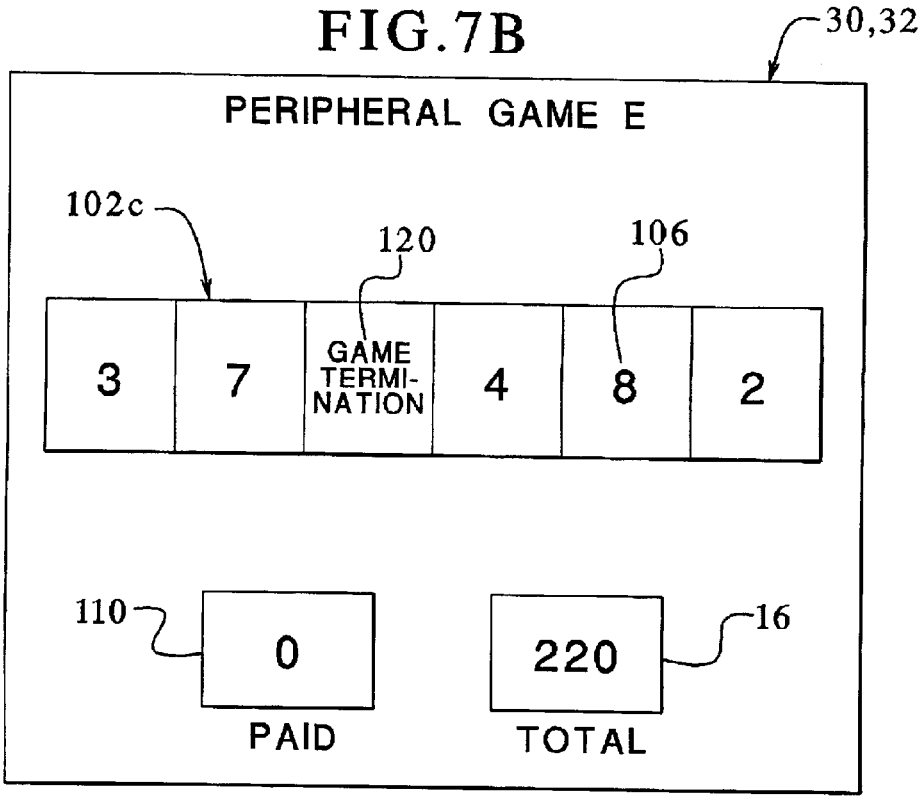
Figure 7C:
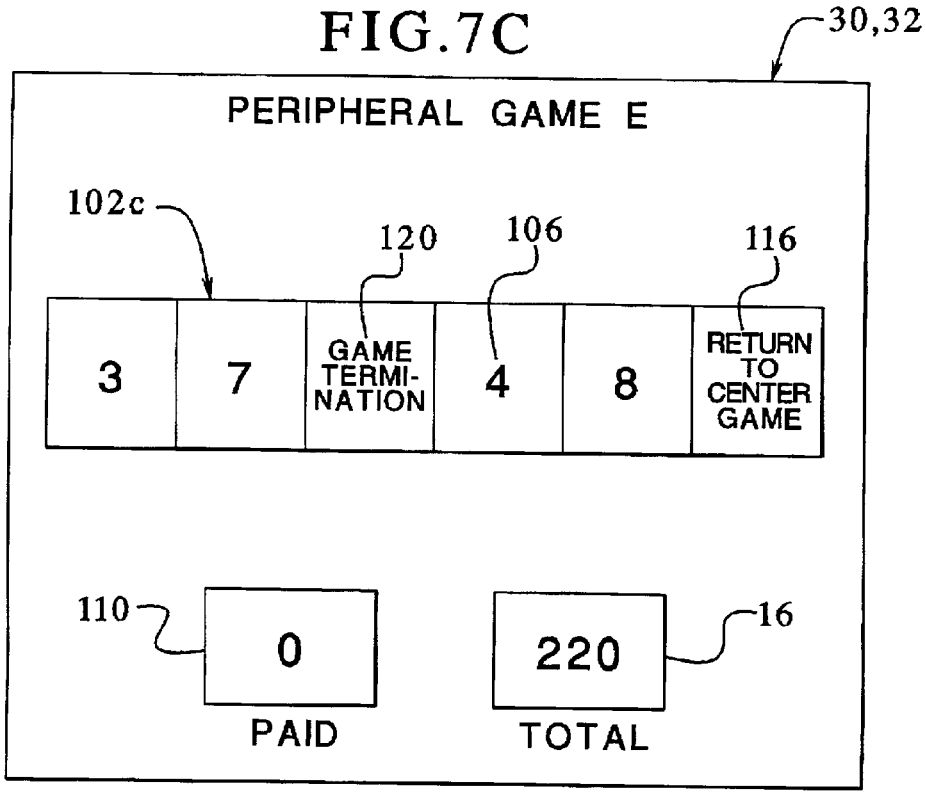

Referring now to FIGS. 7A through 7C, upon the player's pick of the GOTO GAME E outcome 108 in the central game 100*a*, the game preferably discontinues the display of the central game 100*a* on the display device 30 or 32 and displays one of the game terminating embodiments of the peripheral game 102*c*, which is the GAME E. The game preferably retains the display the paid display 110 and the credit display 16. FIGS. 7A and 7B do not enable the player to return to the central game 100*a*, i.e., do not include a return outcome 116, and thus follow the general configuration of FIG. 3B.

FIG. 7A includes only one or more awards 106. The awards range from two to ten, and have a lower average value than the awards of the central game 100*a* or the peripheral games 102*a* and 102*b*, but alternatively include any range and average value. In this embodiment, the game includes enabling the player (or game) to pick selections 112 until picking all of them; however, such a method undermines the excitement of the picking process. Therefore, the embodiment of FIG. 7A includes providing the player (or game) with a percentage of picks from the peripheral game 102*c*, as indicated by the message 118. In FIG. 7A, the game ends after the player (or game) picks two selections. The player (or game) picks well by picking two of the higher values, e.g., the eight and ten awards 106.

FIG. 7B includes a game termination outcome 120 as well as one or more awards 106. The awards 106 again include having any range and average value. In this embodiment, the game includes enabling the player (or game) to pick selections 112 until picking the game termination outcome 120, whereby the game of the present invention ends. The player (or game) picks well, here as well as in any of the do-until or pick-until sequences described above, by obtaining as many awards 106 as possible before picking a game altering outcome, here the termination outcome 120. In the do-until or pick-until sequences of the central game 100*a* and peripheral games 102*a* and 102*b*, picking a game altering outcome did not end the game; but rather, it foreclosed the player from the opportunity of obtaining any more awards 106 in the particular game segment.

FIG. 7C enables the player to return to the central game 100*a*, i.e., includes a return outcome 116, and thus follows the general configuration of FIG. 3A. FIG. 7C also includes the game termination outcome 120 as well as one or more awards 106. The awards 106 again include having any range and average value. In this embodiment, the game includes enabling the player (or game) to pick selections 112: (i) until picking the game termination outcome 120, whereby the game of the present invention ends; or (ii) until picking the return outcome 116, whereby the game returns the player to the current game 100*a*, as described above. The player (or game) again picks well by obtaining as many awards 106 as possible before picking a game altering outcome, the termination outcome 120 or the return outcome 116.

It should be appreciated that with respect to any of the embodiments illustrated by FIGS. 7A through 7C, the game includes any percentage of the peripheral games, even all of the peripheral games, being game terminating peripheral games or having the potential to terminate the game. That is, the game includes a plurality of peripheral games, not just peripheral game 102*c*: (i) providing a dead end or not including the return outcome 116; or (ii) including a termination outcome 120.

Regardless of the embodiment of FIGS. 7A through 7C that the game employs, upon terminating the game and disabling all further picks from a central game 100 or a peripheral game 102, the game preferably reveals all of the final peripheral game's outcomes and the arrangement thereof and all of the central outcomes and the arrangement thereof. That is, the game displays the fully revealed screen of FIGS. 7A through 7C and then displays the fully revealed screen of FIG. 4A. Revealing provides enjoyment and excitement by informing the player where the valuable awards 106 are located or where a particular transfer 108 is located.

Alternative Central Game Embodiment

Figure 8:
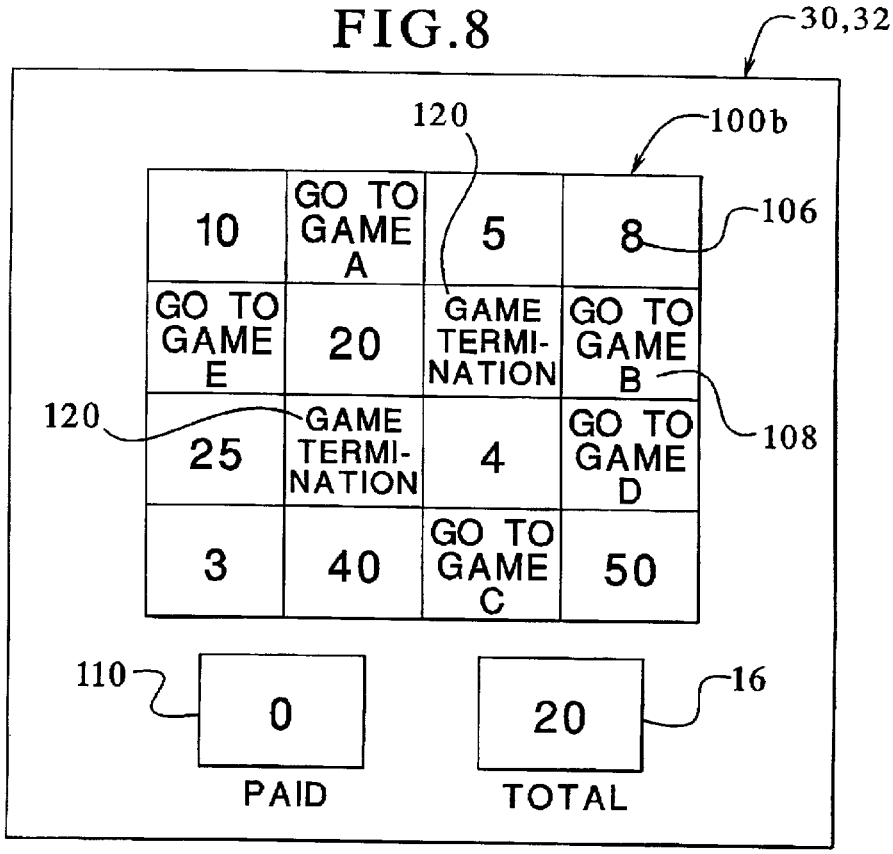
FIG. 8 is a front elevation view of one of the display devices of FIGS. 1A and 1B illustrating one alternative embodiment of a central game having the selections unmasked to show each possible central game outcome.

Referring now to FIG. 8, one alternative embodiment of a central game 100*b* is illustrated fully revealed on one of the display devices 30 or 32 to show each of its central game outcomes. The central game 100*b* includes one or more game termination outcomes 120 in addition to one or more award outcomes 106 or awards 106 and one or more transfers 108. The embodiment of FIG. 8 also includes a paid display 110 and a credit display 16, showing the twenty awards that the player has before game play.

Besides the two game termination outcomes 120, the fully revealed central game 100*b* is exactly the same as the fully revealed central game 100*a* of FIG. 4A. The central game 100*b* includes each of the dedicated transfers for the peripheral GAME A through GAME E, as above. The operation of a game including the central game 100*b* is as described above in FIG. 4A, i.e., the player picks and receives awards 106 until picking a game altering outcome. The difference between the central game 100 and the central game 100*a* is that the game altering outcomes also include one or more game termination outcomes 120, the pick of any of which terminates the game of the present invention.

It should be appreciated that the central games 100*a* and 100*b* have been illustrated as selection grids having player selectable selections 112, however, the present invention includes the central games having any shape or display of selections 112, in any desired display arrangement and including any type of selection 112, which is player selectable. The game includes enabling the player to pick any simulated or electromechanical selection 112.

Alternative Peripheral Game Embodiments

Figure 9A:
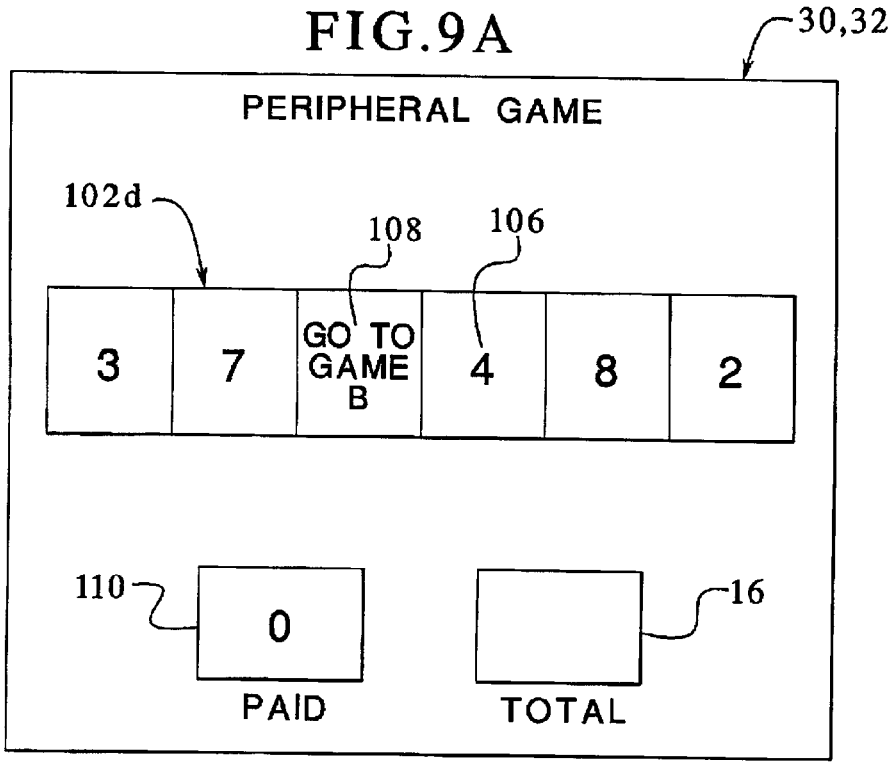
FIGS. 9A and 9B are front elevation views of one of the display devices of FIGS. 1A and 1B illustrating two alternative peripheral game embodiments, wherein game play shifts to one or more other peripheral games.
Figure 9B:
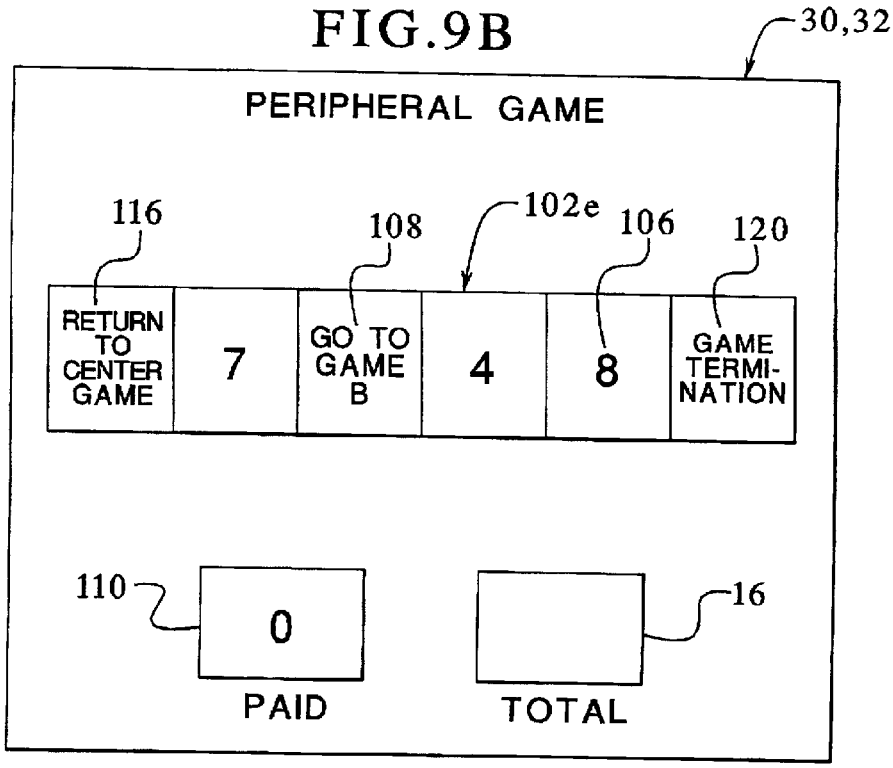

Referring now to FIGS. 9A and 9B, alternative peripheral game embodiments 102*d* and 102*e* are illustrated fully revealed on one of the display devices 30 or 32 to show each of their outcomes. In FIG. 9A, the alternative peripheral game 102*d* includes one or more transfers 108 in addition to one or more award outcomes or awards 106. The embodiment of FIG. 9A also includes a paid display 110 and a credit display 16. The operation of a game including the alternative peripheral game 102*d* is as described above in FIGS. 5A and 6A, i.e., the player (or game) picks and receives awards 106 until picking a game altering outcome. The difference in the peripheral game 102*d* is that the game altering outcome includes one or more transfers 108 instead of one or more return outcomes 116.

In FIG. 9B, the alternative peripheral game 102*e* includes one or more transfers 108, one or more return outcomes 116 and one or more game termination outcomes 120 in addition to one or more awards 106. The embodiment of FIG. 9B also includes a paid display 110 and a credit display 16. The operation of a game including the alternative peripheral game 102*e* is as described above in FIGS. 5A and 6A, i.e., the player (or game) picks and receives awards 106 until picking a game altering outcome. The difference in the peripheral game 102*e* is that the game altering outcome includes one or more transfers 108 and one or more game termination outcomes 120 in addition to one or more return outcomes 116.

In FIGS. 9A and 9B, the pick of a particular transfer 108, e.g., GOTO GAME B initiates the play of a particular peripheral game and designates the peripheral game that the processor 38 or computer enables. The game includes an alternative method of selecting and initiating a peripheral game, which is described below. The game preferably designates a different peripheral game than the current peripheral game. That is, the peripheral game 102*e* preferably does not re-designate the peripheral game 102*e*. Alternatively, the peripheral game randomly redesignates the same peripheral game or a previously chosen peripheral game. The present invention includes providing a plurality of peripheral games, such as peripheral games 102*d* and 102*e*, which transfer play to other peripheral games. In this way, the game implementor is enabled to structure potential access to any peripheral game 102 via a central game 100, another peripheral game 102 or both.

It should be appreciated that the peripheral games 102 have been illustrated as rows of selections 112, however, the present invention includes the peripheral games 102 having any shape or display of selections 112, in any desired display arrangement and including any type of selection 112, which is player or processor selectable. The game includes enabling the processor to randomly pick one or more of the peripheral game selections 112 for the player. The peripheral games 102 have also been illustrated as each including an individual screen separate and apart from the central game 100 and other peripheral games 102. The present invention also includes providing the central and any or all the peripheral games on one screen or the central games 100 and any or all the peripheral games 102 on two separate screens.

In various embodiments, the central game 100 and/or the one or more or all of the peripheral games 102 may be provided on one or more spinning wheels or lighted boxes. For example, the central game 100 and each peripheral game 102 may be provided on separate spinning wheels or lighted boxes. The separate wheels or boxes in one embodiment are physically separate. In another embodiment, the wheels are displayed separately on one or both of the display devices 30 or 32.

The wheels in one embodiment define pie-shaped wedges, wherein each wedge displays a separate award 106 or transfer 108. For example, instead of the central game 100*a* being displayed on a grid as in FIGS. 4A to 4G, the sixteen squares are distinguished by sixteen wedges. The wedges may be masked or the wedges can display the awards 106 and the transfers 108. When displayed, the outcomes are not player selectable; rather, the wheel randomly generates an award 106 or a transfer 108.

In another example, instead of the peripheral game 102*a* being displayed in a row as in FIGS. 5A to 5D, the six squares are distinguished by six wedges. The wedges again may be masked or the wedges can display the awards 106 and the return outcomes 116. When displayed, the outcomes are not player selectable; rather, the wheel randomly generates an award 106 or a return outcome 116. Further, as described in connection with FIGS. 9A and 9B, the wheel can randomly generate the game termination 120 or the transfer to another peripheral game outcome 108.

When the wheels randomly generate outcomes, the wheels in one embodiment are enabled to generate the same outcome more than once. Alternatively, gaming device 10 does not enable the same outcome to be randomly generated a second time, thus increasing the chances of generating the remaining unselected outcomes.

Databases

Figure 10A:
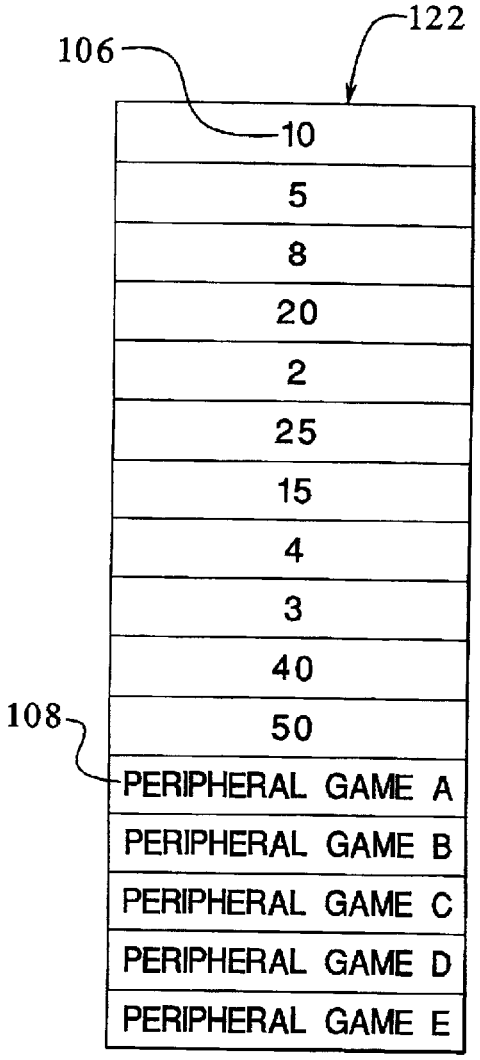
FIGS. 10A and 10B are tables that illustrate at least a portion of an outcome database, which the game of one embodiment of the present invention employs to generate an outcome.

Referring now to FIG. 10A, an outcome table 122 illustrates at least a portion of an outcome database that the present invention employs to generate outcomes in a central game 100. The outcome table 122 includes a plurality of awards 106, shown here as having the same values as the awards 106 of FIG. 4A. It should be appreciated that the present invention includes the outcome table 122 having any desired number of awards 106 and any desired value distribution. The outcome table 122 includes a plurality of transfers 108, shown here as the same outcomes as the outcomes 108 of FIG. 4A. The game preferably includes a transfer 108 for each peripheral game 102. The present invention includes the game being enabled or not being enabled to randomly select and assign the same award 106 or transfer 108 a plurality of times.

The present invention includes adapting the game to randomly generate the outcomes 106 or 108 from the outcome table 122 using one of two methods. In a first outcome generation embodiment, which is preferably used in determining the outcome distribution illustrated in FIG. 4A, the game randomly assigns an award to each of the selections 112 of the central game 100 before the player begins picking selections 112. The game then generates an award depending upon which selector 112 the player picks. In this embodiment, the game is enabled to reveal the outcomes 106 or 108 of unpicked selections when the game terminates. This embodiment includes the player being enabled or not being enabled to pick the same selector 112 a plurality of times.

In a second outcome generation embodiment, the game randomly assigns an outcome 106 or 108 to a pick of an order. That is, the player makes a first pick, a second pick, a third pick, etc. The game randomly assigns, e.g., the 4 award to the first pick, the 20 award to the second, the GOTO GAME D outcome to the third, etc. The present invention includes the game randomly assigning outcomes to a plurality or all of the picks before the player begins picking selections or alternatively assigning each award directly after the player picks a selector. In this embodiment, the selector 112 that the player picks is irrelevant to which outcome the game generates. That is, picking the same selector twice likely generates different outcomes. This embodiment includes the player being enabled or not being enabled to pick the same selector 112 a plurality of times.

Figure 10B:
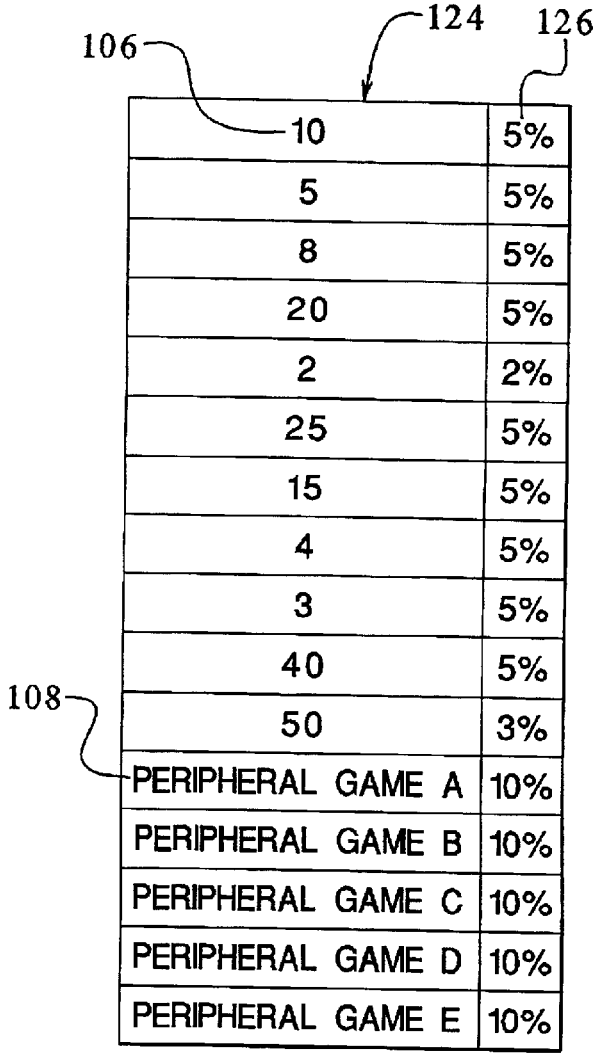

Referring now to FIG. 10B, an outcome table 124 illustrates at least a portion of an alternative weighted outcome database that the present invention employs to generate an award. The outcome table 124 includes a plurality of outcomes 106 and 108 having any desired predetermined distribution of values. The outcomes 106 and 108 each include an associated likelihood percentage 126 that the game will select the particular outcome. The game contemplates the likelihood percentages 126 having any desired distribution, wherein the percentages preferably add to 100%. In the award table 124, the game is weighted such that it is as likely to select one of five transfers 108 as it is to select one of eleven awards 106.

Tables 122 and 124 illustrate database portions for the central game 100. It should be appreciated that the present invention includes similar non-weighted or weighted tables (not illustrated) for the peripheral games 102. In the peripheral game tables, the implementor enters one or more of each type of desired outcome including: (i) awards 106; (ii) transfers 108; (iii) game termination outcomes 120; and (iv) return outcomes 116. The implementor is enabled to weight the outcomes to achieve any desired likelihood of selection distribution among the different types of outcomes.

Figure 11A:
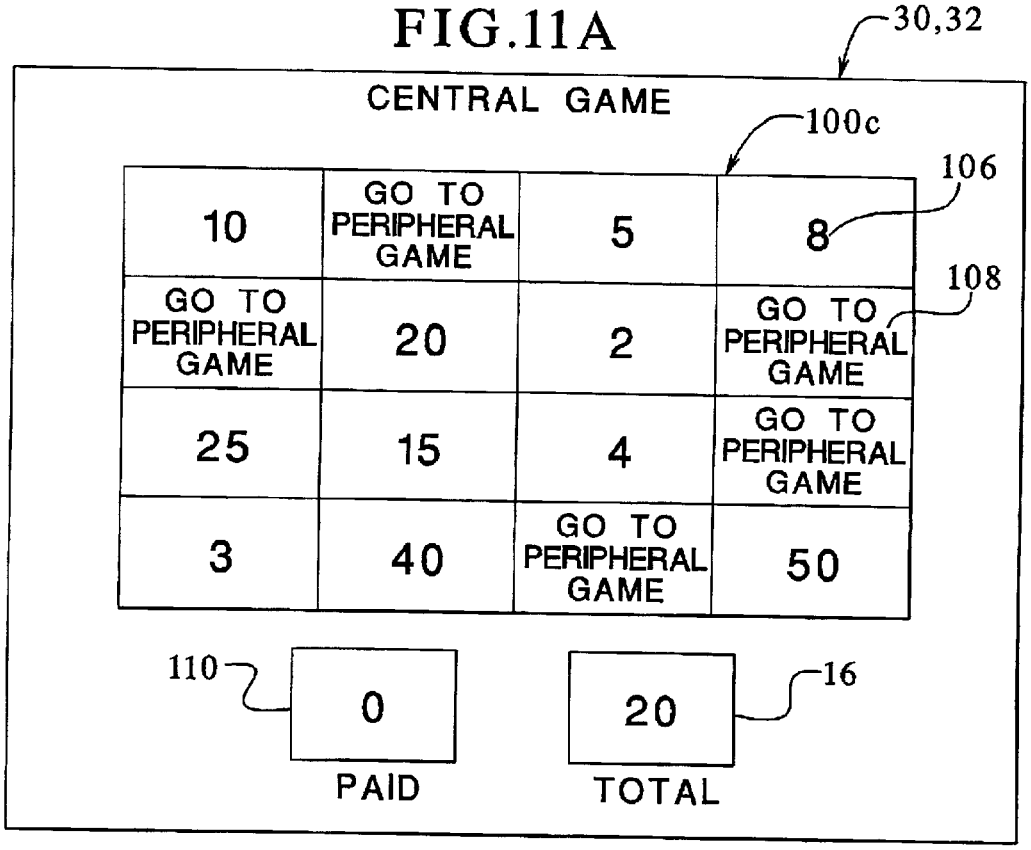
FIG. 11A is a front elevation view of one of the display devices of FIGS. 1A and 1B illustrating an alternative embodiment of a central game fully revealed to show an alternative transfer.
Figure 11C:
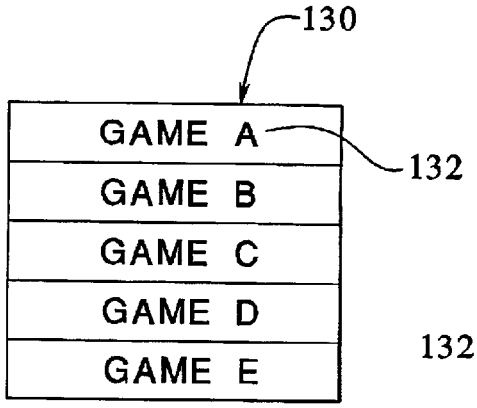
FIGS. 11C and 11D are tables that illustrate transfers, which the game of the present invention employs to generate an outcome.
Figure 11D:
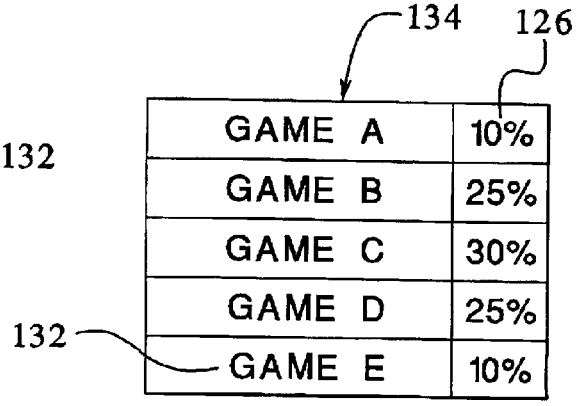
Figure 11B:
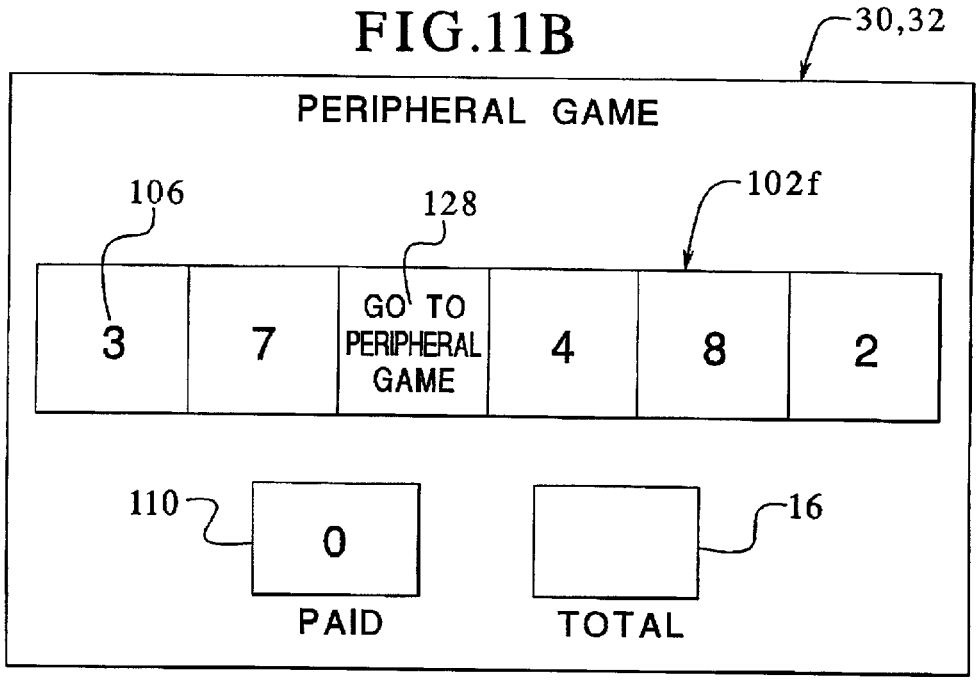
FIG. 11B is a front elevation view of one of the display devices of FIGS. 1A and 1B illustrating an alternative embodiment of a peripheral game with the selections unmasked to show an alternative transfer.

Referring now to FIGS. 11A and 11B, an alternative central game 100*c* and an alternative peripheral game 102*f*, respectively, illustrate an alternative transfer outcome 128. The transfer outcomes 108 discussed in connection with FIGS. 4A, 4D, 4F, 4G, 9A and 9B have all included a designation that the processor 38 or computer uses to thereafter enable a particular peripheral game 102. The alternative transfer outcome 128 as illustrated in the central game 100*c* of FIG. 11A and in the peripheral game 102*f* of FIG. 11B does not include such a designation. The alternative transfer outcome 128 only directs the processor 38 or computer to go to a peripheral game 102.

Referring now to FIGS. 11C and 11D, a peripheral game designation table 130 and weighted peripheral game designation table 134 illustrate databases that the present invention employs to designate a peripheral game 102 after the game generates an alternative transfer outcome 128. The table 130 of FIG. 11C includes a plurality of peripheral game designations 132. The game preferably includes a separate peripheral game designation 132 for each peripheral game 102 and does not include peripheral game designations 132 for which there is no peripheral game 102.

The table 134 of FIG. 11D includes a plurality of peripheral game designations 132, each having the associated likelihood percentage 126 that the game will select a particular designation 132. The game contemplates the likelihood percentages 126 having any desired distribution, wherein the percentages preferably add to 100%. In the peripheral game designation table 134, the game is weighted such that it is equally as likely to select one of GAME B or GAME D as it is to select one of GAME A, GAME C or GAME D.

Preferred Central Game Embodiment

Figure 12:
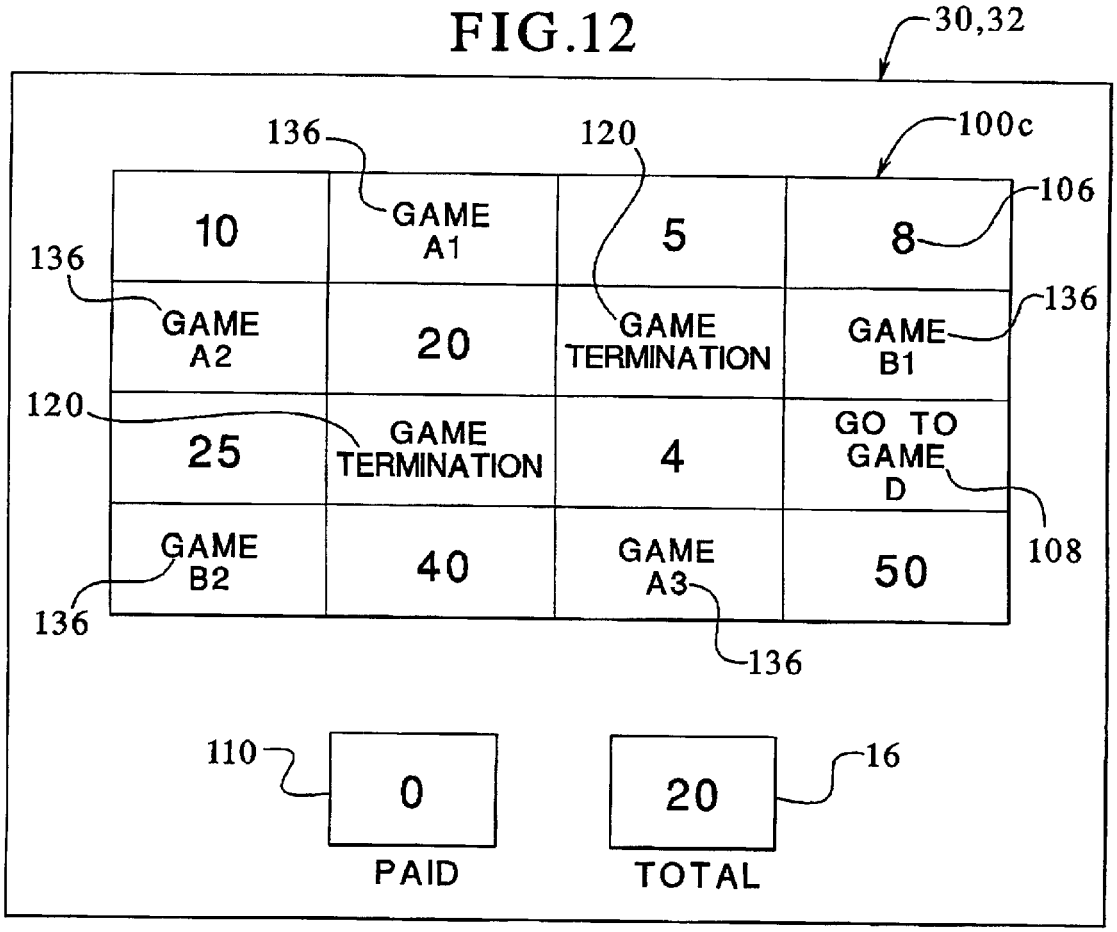
FIG. 12 is a front elevational view of one of the display devices of FIGS. 1A and 1B illustrating one preferred embodiment of a central game having the selections unmasked to show each possible central game outcome.

Referring now to FIG. 12, one preferred embodiment of a central game 100*c* is illustrated fully revealed on one of the display devices 30 or 32 to show each of its central game outcomes. The preferred central game 100*c* includes one or more game termination outcomes 120, one or more award outcomes or awards 106, one or more transfer outcomes 108 and one or more preferred transfers 136. The preferred transfers 136 are transfer components or conditions. That is, the central game 100*a* requires the player to pick and obtain the transfer outcome components, GAME A1, GAME A2 and GAME A3 before transferring to the peripheral GAME A. Each of the components are thus conditions to the player reaching the peripheral GAME A.

The preferred central game 100*c* includes requiring the player to pick any number of preferred transfer outcome components or conditions to transfer to a particular peripheral game 102. FIG. 12 includes two transfer outcome components, GAME B1, GAME B2, which the player must pick before the game transfers to the peripheral GAME B. The preferred central game 100*c* includes additionally having or not having the transfer outcomes 108, such as GOTO GAME D, the selection of which yields an immediate transfer to a peripheral game. The preferred central game 100*c* includes preferably having and alternatively not having the game termination outcomes 120. The preferred central game 100*c* can be provided on a spinning wheel where, in one embodiment, the wheel randomly generates the awards 106 and the transfer outcomes 108.

The preferred embodiment of FIG. 12 also includes a paid display 110 and a credit display 16, showing the twenty awards that the player has before game play. The central game 100*c* includes displaying each of the dedicated transfers for the transfer GAME A through GAME E as above. The operation of a game including the preferred central game 100*c* is as described above in FIG. 4A, i.e., the player picks and receives awards 106 until picking a game altering outcome. The difference in the preferred central game 102*c*, versus other central game embodiments, is that the preferred transfers 136 are only components or conditions of a transfer, wherein the game requires the player to pick at least two transfers 136 before transferring the player to a peripheral game 102.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a central game including a plurality of first selections and at least one player selectable transfer to a peripheral game outcome associated with one of the first selections; and a plurality of peripheral games, wherein at least one of the peripheral game games includes a plurality of second selections and a player selectable return to the central game outcome associated with one of the second selections and a player selectable transfer to another peripheral game outcome associated with one of the second selections, wherein the player selectable transfer to another peripheral game outcome causes a transfer to another one of said other peripheral games.

2. The gaming device of claim 1, wherein at least one of the peripheral games includes a plurality of the return to the central game outcomes.

3. The gaming device of claim 1, wherein at least one of the peripheral games includes a plurality of transfer to another peripheral game outcomes.

4. The gaming device of claim 1, wherein the central game or at least one of the peripheral games includes at least one game terminator.

5. The gaming device of claim 1, wherein the central game or at least one of the peripheral games includes at least one award.

6. The gaming device of claim 1, wherein each of the peripheral games includes a return to the central game outcome.

7. The gaming device of claim 1, wherein each of the peripheral games includes a transfer to another peripheral game outcome.

8. The gaming device of claim 1, wherein at least one of the peripheral games includes a game terminator.

9. The gaming device of claim 1, wherein the central game includes a plurality of transfer to a peripheral game outcomes, each said transfer associated with one of said peripheral games.

10. The gaming device of claim 1, wherein the transfer to a peripheral game outcome in the central game includes a plurality of transfer components each associated with different ones of the first selections.

11. The gaming device of claim 1, wherein the central game includes at least one game terminator outcome.

12. The gaming device of claim 1, wherein the central game includes at least one award outcome.

13. The gaming device of claim 1, wherein the central game and the peripheral games are displayed on a single display.

14. The gaming device of claim 1, wherein the central game and the peripheral games are displayed on separate displays.

15. The gaming device of claim 1, wherein each of the peripheral games is displayed on a separate display.

16. The gaming device of claim 1, wherein at least one of the central game and the peripheral games is displayed on an electromechanical device.

17. The gaming device of claim 1, wherein at least one of the central game and the peripheral games is displayed on a wheel.

18. The gaming device of claim 1, wherein the central game and the peripheral games are each displayed on a separate wheel.

19. The gaming device of claim 18, wherein the separate wheels are displayed on a single display device.

20. A gaming device comprising:

a central game including a plurality of first selections and a transfer to a peripheral game outcome associated with one of the first selections or a plurality of transfer component outcomes each associated with different ones of the first selections; and a plurality of peripheral games, at least one of which includes a plurality of second selections and a return to central game outcome associated with one of the second selections and a transfer to another peripheral game outcome associated with another one of the second selections, wherein the peripheral game is played after the transfer or the plurality of transfer components are is selected by a player, and wherein the central game is replayed after the return outcome is selected by the player.

21. The gaming device of claim 20, which includes a plurality of peripheral games and a corresponding transfer outcome or a plurality of transfer components for each peripheral game.

22. The gaming device of claim 21, wherein one of the peripheral games is randomly chosen after the transfer or the plurality of transfer components are selected.

23. The gaming device of claim 20, wherein the central game and the peripheral games each include at least one award outcome.

24. The gaming device of claim 23, wherein the at least one award outcome of the central game has a different value than the at least one award outcome of the peripheral games.

25. The gaming device of claim 20, wherein one of the central game and the peripheral games includes an award outcome.

26. The gaming device of claim 20, wherein one of the central game and the peripheral games includes a game terminator outcome.

27. The gaming device of claim 20, wherein the central game and said peripheral games each include a game terminator outcome.

28. The gaming device of claim 20, wherein the central game includes a plurality of transfer outcomes and each of the peripheral games includes the return outcome or the transfer to another peripheral game outcome.

29. A gaming device comprising:

a central game including a plurality of first selections and a plurality of player selectable transfer to a peripheral game outcomes each associated with a different one of the first selections; and a plurality of peripheral games each including a plurality of second selections, a player selectable return to the central game outcome associated with one of said second selections of said peripheral game and a player selectable transfer to another peripheral game outcome associated with one of said second selections of said peripheral game, wherein (i) a player initially plays the central game, (ii) the player plays one of the peripheral games after said player picks one of the transfer outcomes, (iii) the player plays the central game again if the player picks the return outcome in the played peripheral game, and (iv) the player plays another peripheral game if the player picks the transfer to another peripheral game outcome in the played peripheral game.

30. The gaming device of claim 29, wherein one of the transfer outcomes in the central game includes a plurality of player selectable transfer components.

31. The gaming device of claim 29, wherein the central game and each peripheral game include at least one award outcome.

32. The gaming device of claim 29, wherein the transfer outcomes in the central game can be reselected so that the player plays the same peripheral game more than once.

33. The gaming device of claim 29, wherein the transfer outcomes in the central game cannot be reselected so that the player cannot replay the peripheral games.

34. A gaming device comprising;

a central game including a plurality of first selections and at least one player selectable central game award outcome associated with one of the first selections, at least one player selectable central game termination outcome associated with another one of said first selections, and a plurality of player selectable peripheral game transfers to a plurality of different peripheral games each associated with other different ones of the first selections;

each peripheral game including a plurality of second selections, at least one peripheral game award associated with one of said second selections of said peripheral game, at least one central game return award associated with another one of said second selections of said peripheral game, and at least one peripheral game transfer award associated with another one of said second selections of said peripheral game;

a display device operable to display the central game, central game award outcome, central game terminator outcome, peripheral game transfers, peripheral game outcomes and central game returns; and a processor which controls the central game, peripheral game and display device.

35. The gaming device of claim 34, which includes at least one termination outcome associated with at least one of the peripheral games.

36. A method for operating a gaming device, said method comprising the steps of:

(a) enabling a player to play a central game that includes a plurality of first selections and at least one player selectable transfer to a peripheral game outcome associated with one of the first selections;

(b) transferring to a first peripheral game when the transfer outcome is selected by the player;

(c) enabling the player to play the first peripheral game, the first peripheral game including a plurality of second selections and a player selectable return to the central game outcome associated with one of the second selections and a player selectable transfer to another peripheral game outcome associated with another one of the second selections;

(d) transferring back to the central game if the return outcome is selected by the player and enabling the player to play the central game; and (e) transferring to a second peripheral game if the transfer to another peripheral game outcome is selected by the player and enabling the player to play the second peripheral game.

37. The method of claim 36, which includes a plurality of peripheral games, a transfer outcome for a plurality of the peripheral games and repeating steps (a) to (e) a plurality of times.

38. The method of claim 36, wherein transferring to the first peripheral game from the central game includes playing the first peripheral game on a different electromechanical device than a device on which the central game is played.

39. The method of claim 38, wherein the electromechanical devices are spinning wheels.

40. The method of claim 36, wherein transferring to the second peripheral game from the first peripheral game includes playing the second peripheral game on a different electromechanical device than a device on which the first peripheral game is played.

41. The method of claim 40, wherein the first and second peripheral games are played on electromechanical spinning wheels.

42. The method of claim 36, wherein the steps (a) to (e) are provided to the player through a data network.

43. The method of claim 42, wherein the data network is an internet.

44. A gaming device comprising:

a central game including a plurality of first selections, at least one of said first selections including a transfer to another game;

a plurality of peripheral games, at least one of said peripheral games including a plurality of second selections, at least one of said second selections including a transfer to said central game, and at least one of said second selections including a transfer to another one of said peripheral games;

a display device operable to display the central and peripheral games; and a processor operable with the display device to enable a player to pick at least one of said first selections in said central game, initiate one of said peripheral games if the player picks one of said first selections including a transfer to said peripheral game, enable a player to pick at least one of said second selections in said peripheral game if said player picks one of the first selections including a transfer to said peripheral game, initiate another of said peripheral games if the player picks one of the second selections including a transfer to said another peripheral game and transfer the player to the central game if the player picks one of the second selections including the transfer to said central game.

45. The gaming device of claim 44, wherein the plurality of peripheral games includes a first peripheral game including the transfer to the central game and the transfer to another of said peripheral games, and a second peripheral game including a transfer to said first peripheral game.

46. The gaming device of claim 44, wherein the plurality of peripheral games includes a first peripheral game including the transfer to the central game and a plurality of transfers to other of said peripheral games, a second peripheral game including a transfer to said first peripheral game, and a third peripheral game including a transfer to said central game.

47. The gaming device of claim 44, wherein the plurality of peripheral games includes a first peripheral game including the transfer to another of said peripheral games, and a second peripheral game including a transfer to the central game and a transfer to said first peripheral game.

48. The gaming device of claim 44, wherein the plurality of peripheral games includes a first peripheral game including the transfer to the central game and a plurality of transfers to other of said peripheral games, a second peripheral game including a transfer to said first peripheral game, a third peripheral game including a transfer to said central game, and a fourth peripheral game including a transfer to said third peripheral game.

49. The gaming device of claim 44, wherein the plurality of peripheral games includes a first peripheral game including the transfer to the central game and a plurality of transfers to other of said peripheral games, a second peripheral game including a transfer to said central game, and a third peripheral game including a transfer to said second peripheral game.

50. The gaming device of claim 44, wherein the plurality of peripheral games includes a first peripheral game including the transfer to the central game and a plurality of transfers to other of said peripheral games, a second peripheral game including a transfer to said first peripheral game, a third peripheral game including a transfer to said central game, a fourth peripheral game including a transfer to said third peripheral game, and a fifth peripheral game including a transfer to said central game.

51. A gaming device comprising:

a display device;

a central game displayed by said display device, said central game including a plurality of first selections, said first selections including at least one award, at least one terminator and at least one transfer to one of a plurality of different peripheral games;

a plurality of peripheral games, at least one of said peripheral games including a plurality of second selections, said second selections including at least one award, at least one terminator, at least one transfer to one of the peripheral games and at least one transfer to the central game; and a processor operable with the display device to enable a player to pick one of said first selections in said central game, provide an award to the player when the player picks the first selection including the award, terminate the central game when the player picks the first selection including the terminator, initiate one of said peripheral games when the player picks the first selection including a transfer to said peripheral game, enable a player to pick one of said second selections in said peripheral game when said player picks the first selection including the transfer to said peripheral game, provide the award to the player when the player picks the second selection including the award, initiate another of said peripheral games when the player picks the second selection including the transfer to said another peripheral game, transfer the player to the central game when the player picks one of the second selections including the transfer to said central game and terminate the peripheral game when the player picks the second selection including the terminator.

* * * * *

UNITED STATES PATENT AND TRADEMARK OFFICE

CERTIFICATE OF CORRECTION

PATENT NO. : 6,786,819 B2
DATED : September 7, 2004
INVENTOR(S) : Baerlocher et al.

It is certified that error appears in the above-identified patent and that said Letters Patent is hereby corrected as shown below:

Column 17,
Line 57, change “peripheral game games includes” to -- peripheral games includes --.

Column 18,
Lines 60-61, change “the plurality of transfer components are is selected by a player” to -- the plurality of transfer components are selected by a player --.

Signed and Sealed this

First Day of November, 2005

JON W. DUDAS
*Director of the United States Patent and Trademark Office*